US008786541B2

(12) United States Patent
Heishi et al.

(10) Patent No.: US 8,786,541 B2
(45) Date of Patent: Jul. 22, 2014

(54) LIGHT EMISSION CONTROL DEVICE AND METHOD, LIGHT EMISSION DEVICE, IMAGE DISPLAY DEVICE, PROGRAM, AND RECORDING MEDIUM

(75) Inventors: Akinori Heishi, Tokyo (JP); Satoshi Yamanaka, Tokyo (JP); Hideki Yoshii, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 13/984,754

(22) PCT Filed: Dec. 5, 2011

(86) PCT No.: PCT/JP2011/078067

§ 371 (c)(1),
(2), (4) Date: Aug. 9, 2013

(87) PCT Pub. No.: WO2012/108095

PCT Pub. Date: Aug. 16, 2012

(65) Prior Publication Data

US 2013/0321491 A1 Dec. 5, 2013

(30) Foreign Application Priority Data

Feb. 9, 2011 (JP) ..... 2011-026067

(51) Int. Cl.
*G09G 3/36* (2006.01)

(52) U.S. Cl.
USPC ..... 345/102; 345/690; 345/204

(58) Field of Classification Search
USPC ..... 345/87–104, 204–214, 690–699
See application file for complete search history.

(56) References Cited

U.S. PATENT DOCUMENTS

| | | | | |
|---|---|---|---|---|
| 8,248,359 | B2 * | 8/2012 | Inada et al. | 345/102 |
| 2007/0097321 | A1 * | 5/2007 | Whitehead et al. | 353/30 |
| 2007/0159451 | A1 * | 7/2007 | Daly | 345/102 |
| 2007/0296886 | A1 * | 12/2007 | Inada et al. | 349/61 |
| 2008/0111784 | A1 | 5/2008 | Tanaka et al. | |
| 2008/0297463 | A1 | 12/2008 | Tsuru et al. | |
| 2009/0015541 | A1 | 1/2009 | Honbo | |
| 2009/0109165 | A1 | 4/2009 | Park et al. | |
| 2009/0115720 | A1 | 5/2009 | Inada et al. | |
| 2009/0140975 | A1 | 6/2009 | Nonaka et al. | |
| 2009/0146941 | A1 | 6/2009 | Fujine et al. | |

(Continued)

FOREIGN PATENT DOCUMENTS

| | | | |
|---|---|---|---|
| JP | 2004-350179 | A | 12/2004 |
| JP | 2007-140483 | A | 6/2007 |

(Continued)

*Primary Examiner* — Dmitriy Bolotin
(74) *Attorney, Agent, or Firm* — Birch, Stewart, Kolasch & Birch, LLP

(57) ABSTRACT

A light emission control device includes a partial region feature quantity detector, an enlarged region feature quantity detector, a whole screen feature quantity detector, and a light emission controller. The partial region feature quantity detector detects a feature quantity of the image as a partial region feature quantity. The enlarged region feature quantity detector defines the partial region of interest and the partial regions neighboring the partial region of interest, and detects a feature quantity of the image of the enlarged region. The whole screen feature quantity detector detects this feature quantity as a whole screen feature quantity. On the basis of the partial region feature quantity and the enlarged region feature quantity pertaining to the partial region of interest, and the whole screen feature quantity, the light emission controller controls the light emission luminance of the light emission unit corresponding to the partial region of interest.

9 Claims, 14 Drawing Sheets

(56) References Cited

U.S. PATENT DOCUMENTS

| | | | | |
|---|---|---|---|---|
| 2010/0110112 | A1 | 5/2010 | Nakanishi | |
| 2010/0128051 | A1 | 5/2010 | Mizuta et al. | |
| 2011/0249039 | A1* | 10/2011 | Ogi et al. | 345/690 |
| 2011/0292018 | A1* | 12/2011 | Kubota et al. | 345/211 |
| 2011/0316829 | A1* | 12/2011 | Oka et al. | 345/207 |
| 2012/0113164 | A1* | 5/2012 | Furukawa et al. | 345/690 |
| 2012/0133685 | A1* | 5/2012 | Cho et al. | 345/690 |
| 2012/0139885 | A1* | 6/2012 | Iwasa et al. | 345/207 |
| 2013/0222221 | A1* | 8/2013 | An | 345/102 |

FOREIGN PATENT DOCUMENTS

| | | | |
|---|---|---|---|
| JP | 2007-183499 | A | 7/2007 |
| JP | 2008-90076 | A | 4/2008 |
| JP | 2008-122713 | A | 5/2008 |
| JP | 2008-176211 | A | 7/2008 |
| JP | 2008-203292 | A | 9/2008 |
| JP | 2008-268642 | A | 11/2008 |
| JP | 2008-299191 | A | 12/2008 |
| JP | 2008-304578 | A | 12/2008 |
| JP | 2009-15265 | A | 1/2009 |
| JP | 2009-109975 | A | 5/2009 |
| JP | 2009-116012 | A | 5/2009 |
| JP | 2009-139470 | A | 6/2009 |
| JP | 2009-192717 | A | 8/2009 |
| JP | 2009-192963 | A | 8/2009 |
| JP | 2009-288793 | A | 12/2009 |
| JP | 2010-134435 | A | 6/2010 |

* cited by examiner

FIG.4(a)

Fa(h,v)

| | | | | |
|---|---|---|---|---|
| 0 | 0 | 0 | 0 | 0 |
| 0 | 0 | 0 | 0 | 0 |
| 0 | 0 | 40 | 0 | 0 |
| 0 | 0 | 0 | 0 | 0 |
| 0 | 0 | 0 | 0 | 0 |

FIG.4(b)

Fb(h,v)

| | | | | |
|---|---|---|---|---|
| 0 | 0 | 0 | 0 | 0 |
| 0 | 4 | 4 | 4 | 0 |
| 0 | 4 | 4 | 4 | 0 |
| 0 | 4 | 4 | 4 | 0 |
| 0 | 0 | 0 | 0 | 0 |

FIG.4(c)

Da(h,v)

| | | | | |
|---|---|---|---|---|
| −2 | −2 | −2 | −2 | −2 |
| −2 | −2 | −2 | −2 | −2 |
| −2 | −2 | 38 | −2 | −2 |
| −2 | −2 | −2 | −2 | −2 |
| −2 | −2 | −2 | −2 | −2 |

FIG.4(d)

Db(h,v)

| | | | | |
|---|---|---|---|---|
| −2 | −2 | −2 | −2 | −2 |
| −2 | 3 | 3 | 3 | −2 |
| −2 | 3 | 3 | 3 | −2 |
| −2 | 3 | 3 | 3 | −2 |
| −2 | −2 | −2 | −2 | −2 |

FIG.4(e)

Df(h,v)

| | | | | |
|---|---|---|---|---|
| −3 | −3 | −3 | −3 | −3 |
| −3 | 1 | 1 | 1 | −3 |
| −3 | 1 | 41 | 1 | −3 |
| −3 | 1 | 1 | 1 | −3 |
| −3 | −3 | −3 | −3 | −3 |

FIG.5(a)

Fa(h,v)

| | | | | |
|---|---|---|---|---|
| 25 | 0 | 0 | 0 | 30 |
| 0 | 0 | 0 | 0 | 0 |
| 0 | 0 | 40 | 0 | 0 |
| 0 | 0 | 0 | 0 | 0 |
| 35 | 0 | 0 | 0 | 40 |

FIG.5(b)

Fb(h,v)

| | | | | |
|---|---|---|---|---|
| 6 | 4 | 0 | 5 | 8 |
| 4 | 7 | 4 | 8 | 5 |
| 0 | 4 | 4 | 4 | 0 |
| 6 | 8 | 4 | 9 | 7 |
| 9 | 6 | 0 | 7 | 10 |

FIG.5(c)

Da(h,v)

| | | | | |
|---|---|---|---|---|
| 18 | −7 | −7 | −7 | 23 |
| −7 | −7 | −7 | −7 | −7 |
| −7 | −7 | 33 | −7 | −7 |
| −7 | −7 | −7 | −7 | −7 |
| 28 | −7 | −7 | −7 | 33 |

FIG.5(d)

Db(h,v)

| | | | | |
|---|---|---|---|---|
| −1 | −3 | −7 | −2 | 1 |
| −3 | 0 | −2 | 1 | −2 |
| −7 | −2 | −2 | −2 | −7 |
| −1 | 2 | −2 | 2 | 0 |
| 2 | −1 | −7 | 0 | 3 |

FIG.5(e)

Df(h,v)

| | | | | |
|---|---|---|---|---|
| 18 | −9 | −14 | −9 | 24 |
| −9 | −6 | −9 | −6 | −9 |
| −14 | −9 | 31 | −9 | −14 |
| −8 | −5 | −9 | −5 | −7 |
| 30 | −8 | −14 | −7 | 36 |

FIG.6(a)

Fa(h,v)

| | | | | |
|---|---|---|---|---|
| 0 | 0 | 0 | 0 | 0 |
| 0 | 25 | 0 | 30 | 0 |
| 0 | 0 | 40 | 0 | 0 |
| 0 | 35 | 0 | 40 | 0 |
| 0 | 0 | 0 | 0 | 0 |

FIG.6(b)

Fb(h,v)

| | | | | |
|---|---|---|---|---|
| 6 | 4 | 9 | 5 | 8 |
| 4 | 7 | 11 | 8 | 5 |
| 10 | 11 | 19 | 12 | 12 |
| 6 | 8 | 13 | 9 | 7 |
| 9 | 6 | 13 | 7 | 10 |

FIG.6(c)

Da(h,v)

| | | | | |
|---|---|---|---|---|
| −7 | −7 | −7 | −7 | −7 |
| −7 | 18 | −7 | 23 | −7 |
| −7 | −7 | 33 | −7 | −7 |
| −7 | 28 | −7 | 33 | −7 |
| −7 | −7 | −7 | −7 | −7 |

FIG.6(d)

Db(h,v)

| | | | | |
|---|---|---|---|---|
| −1 | −3 | 2 | −2 | 1 |
| −3 | 0 | 4 | 1 | −2 |
| 3 | 4 | 12 | 5 | 5 |
| −1 | 2 | 6 | 2 | 0 |
| 2 | −1 | 6 | 0 | 3 |

FIG.6(e)

Df(h,v)

| | | | | |
|---|---|---|---|---|
| −7 | −9 | −4 | −9 | −6 |
| −9 | 19 | −3 | 24 | −9 |
| −4 | −2 | 45 | −1 | −2 |
| −8 | 30 | −1 | 35 | −7 |
| −5 | −8 | −1 | −7 | −4 |

| | |
|---|---|
| J(1,1) | J(2,1) |
| J(1,2) | J(2,2) |
| J(1,3) | J(2,3) |
| J(1,4) | J(2,4) |
| J(1,5) | J(2,5) |
| J(1,6) | J(2,6) |
| J(1,7) | J(2,7) |
| J(1,8) | J(2,8) |

FIG.15

| | | | | | | | |
|---|---|---|---|---|---|---|---|
| J(1,1) | J(2,1) | J(3,1) | J(4,1) | J(5,1) | J(6,1) | J(7,1) | J(8,1) |
| J(1,2) | J(2,2) | J(3,2) | J(4,2) | J(5,2) | J(6,2) | J(7,2) | J(8,2) |

LIGHT EMISSION CONTROL DEVICE AND METHOD, LIGHT EMISSION DEVICE, IMAGE DISPLAY DEVICE, PROGRAM, AND RECORDING MEDIUM

TECHNICAL FIELD

The present invention is related to a light, emission control device and method, alight emission device, and an image display device, and in particular to control over light emission luminance of a light emitting unit used for illuminating an optical modulation unit in an image display device. The present invention is also related to a program for having a computer execute the processes of the light emission control method, and a computer-readable recording medium storing the program.

BACKGROUND ART

Display devices such as a liquid crystal panel having passive optical modulation elements is provided with a light source for illuminating the optical modulation elements. Optical modulation elements are responsive to an input image signal to vary the amount of passage of light emitted from the light source, thereby to form an image and display it. When "black" is displayed, the optical modulation elements are in a state of shutting the light emitted from the light source. However, even in the "shutting" state, the light transmittance cannot be made zero, and there is some leakage of light. As a result, even the "black" screen has some brightness ("black offset" due the light leakage).

It has been proposed to control the light source according to the content of the image to be displayed, in order to reduce the black offset. In one method, the light source is controlled evenly throughout the screen. For instance, when the screen is dark, the amount of light from the light source is reduced in order to reduce the black offset. However, a bright image part which may be included in a dark screen is also displayed darkly due to the reduction in the amount of illuminating light, and the dynamic range of the display luminance is reduced.

The below-noted Patent Reference 1 discloses a display device in which the light source of the back light is divided into a plurality of partial regions, and the luminance is controlled region by region, in order to reduce or suppress the black offset, and to enlarge the display luminance dynamic range. In the display device disclosed in Patent Reference 1, the luminance set values for each partial region is renewed using a value obtained by weighting the luminance set value of each partial region, and the luminance set values of adjacent partial regions.

PRIOR ART REFERENCES

Patent References

Patent Reference 1: Japanese Patent Publication No. 2009-139470 (page 9, FIG. 9)

SUMMARY OF THE INVENTION

Problems to be Solved by the Invention

In the method disclosed in Patent Reference 1, the luminance set value of each partial region is renewed, through calculation in which each partial region and each of the adjacent partial regions are weighted, so that a vast amount of calculation is required, and the circuitry of a large size is needed. Moreover, the luminance set value of each partial region is determined by weighting the luminance set values of the partial regions, and a priority is given to such a control as not to have the luminance difference perceived, and suppression of the black offset, and the enlargement of the dynamic range are given less weight.

Means for Solving the Problem

A light emission control device according to the invention is configured to use an optical modulation unit to optically modulate illuminating light according to image data, thereby to form an image represented by the image data, wherein a plurality of light emission units respectively irradiate regions formed by dividing the optical modulation unit into a plurality of regions, the regions which are formed by the division, and which correspond to the respective light emission units are defined as partial regions, light emission luminance of each of the plurality of light emission units can be controlled;

said light emission control device comprising:

a partial region feature quantity detector that defines each of the partial regions of the optical modulation unit, of the image represented by the image data, as a partial region of interest, and detects a feature quantity of the partial region of interest, as a partial region feature quantity;

an enlarged region feature quantity detector that detects a feature quantity of an enlarged region including the partial region of interest, and a partial region neighboring the partial region of interest, of the image represented by the image data, as an enlarged region feature quantity pertaining to the partial region of interest, a whole screen feature quantity detector that detects a feature quantity of entirety of the image represented by the image data, as a whole screen feature quantity; and a light emission controller that controls light emission luminance of the light emission unit corresponding to the partial region of interest, on the basis of the partial region feature quantity pertaining to the partial region of interest, the enlarged region feature quantity pertaining to the partial region of interest, and the whole screen feature quantity.

Effects of the Invention

According to the invention, it is possible to reduce or suppress the luminance differences between partial regions, and suppress the black offset, and increase the dynamic range, without enlarging the size of the circuitry.

BRIEF DESCRIPTION OF THE DRAWINGS

FIGS. 4(*a*) to 4(*e*) are drawings showing data appearing at various parts of the image display device of FIG. 1, when a first example of the input image data is output from a receiving unit 2 in FIG. 1, FIG. 4(*a*) showing feature quantities Fa of the image represented by the image data used for the optical modulation in respective partial regions of the image, output from the partial region feature quantity detector 6, FIG. 4(*b*) showing feature quantities Fb of the image represented by the image data used for the optical modulation in respective enlarged regions, output from the enlarged region feature quantity detector 8, FIG. 4(*c*) showing partial region deviation amount data Da output from a partial region deviation amount calculator 11, FIG. 4(*d*) shows enlarged region deviation amount data Db output from an enlarged region deviation amount calculator 12, and FIG. 4(*e*) showing local deviation amount data Df output from an adder 13;

FIGS. 5(*a*) to 5(*e*) are drawings showing data appearing at various parts of the image display device of FIG. 1, when a second example of the input image data is output from the receiving unit 2 in FIG. 1, FIG. 5(*a*) showing the feature quantities Fa of the image represented by the image data used for the optical modulation in respective partial regions of the image, output from the partial region feature quantity detector 6, FIG. 5(*b*) showing the feature quantities Fb of the image represented by the image data used for the optical modulation in respective enlarged regions, output from the enlarged region feature quantity detector 8, FIG. 5(*c*) showing partial region deviation amount data Da output from the partial region deviation amount calculator 11, FIG. 5(*d*) showing enlarged region deviation amount data Db output from the enlarged region deviation amount calculator 12, and FIG. 5(*e*) showing local deviation amount data Df output from the adder 13;

FIGS. 6(*a*) to 6(*e*) are drawings showing data appearing at various parts of the image display device of FIG. 1, when a third example of the input image data is output from the receiving unit 2 in FIG. 1, FIG. 6(*a*) showing the feature quantities Fa of the image represented by the image data used for the optical modulation in respective partial regions of the image, output from the partial region feature quantity detector 6, FIG. 6(*b*) showing the feature quantities Fb of the image represented by the image data used for the optical modulation in respective enlarged regions, output from the enlarged region feature quantity detector 8, FIG. 6(*c*) showing partial region deviation amount data Da output from the partial region deviation amount calculator 11, FIG. 6(*d*) showing enlarged region deviation amount data Db output from the enlarged region deviation amount calculator 12, and FIG. 6(*e*) showing local deviation amount data Df output from the adder 13;

FIG. 15 is a drawing showing another example of arrangement of partial regions in a situation in which light emission elements are disposed along long edges of the screen.

MODE FOR CARRYING OUT THE INVENTION

Embodiment 1

Figure 1:
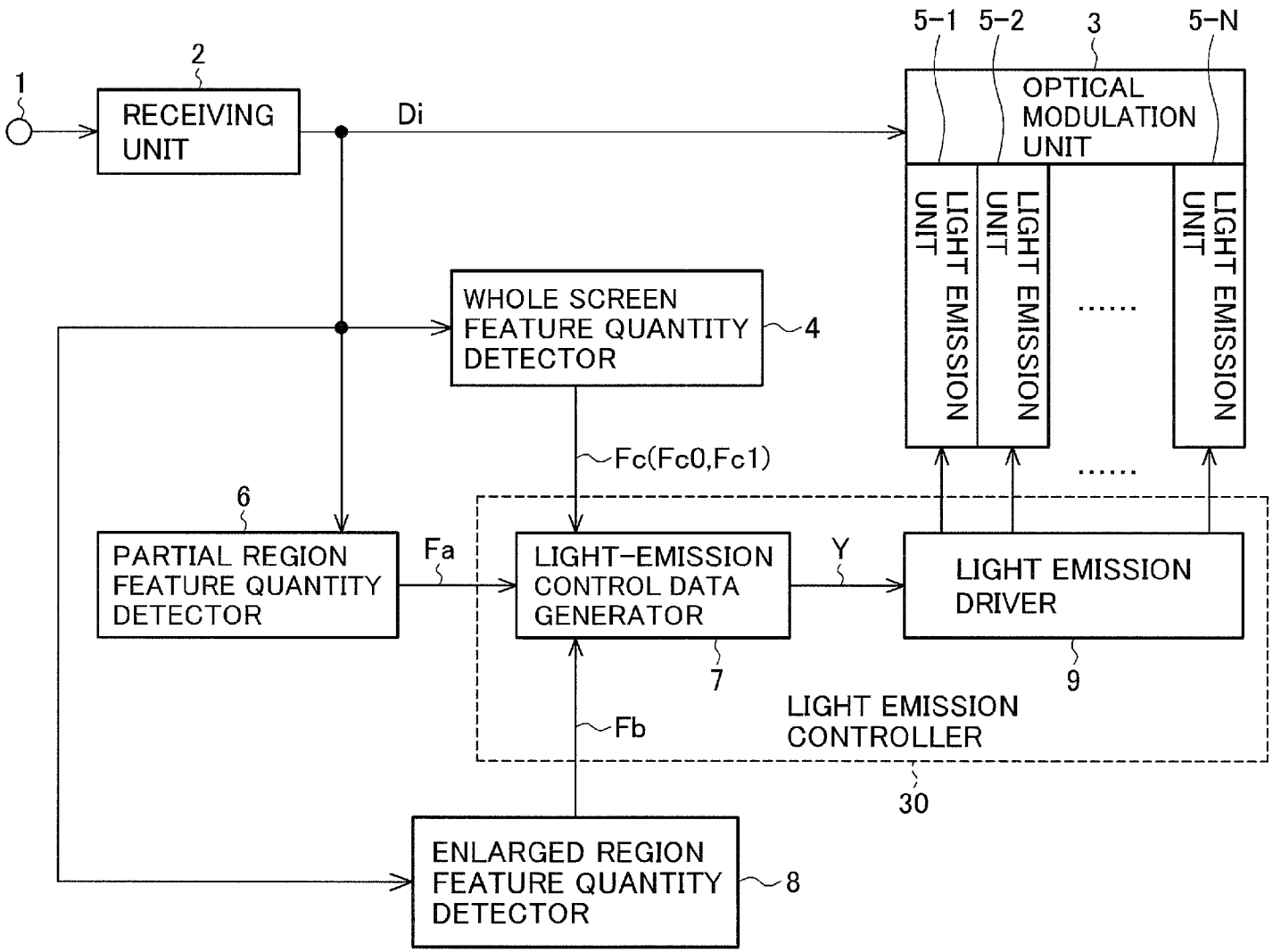
FIG. 1 is a block diagram showing an image display device of Embodiment 1 of the present invention.

FIG. 1 is a block diagram showing an image display device according to Embodiment 1 of the present invention. The image display device shown in FIG. 1 includes an input terminal 1, a receiving unit 2, an optical modulation unit 3, a plurality of, e.g., N (N being an integer not smaller than 2) light emission units 5-1 to 5-N, a partial region feature quantity detector 6, an enlarged region feature quantity detector 8, a whole screen feature quantity detector 4, a light-emission control data generator 7, and a light emission driver 9. Among the members listed above, the partial region feature quantity detector 6, the enlarged region feature quantity detector 8, the whole screen feature quantity detector 4, the light-emission control data generator 7, and the light emission driver 9 in combination forma light emission control device, and the light emission control device and the light emission units 5-1 to 5-N in combination forma light emission device.

Supplied to the input terminal 1 is an image signal of a predetermined format used in television, computers, or the like.

The receiving unit 2 receives the image signal supplied to the input terminal 1, and converts it to image data formed of RGB color data, or image data consisting of luminance data and color difference data. The image data includes pixel values for determining the light transmittance at each of the pixels in the optical modulation unit 3 to be described later. The receiving unit 2 may be formed of an A/D converter and the like, when the input image signal is in an analog form. The receiving unit 2 may comprise a decoder when the input image signal is a modulated image signal.

The image data output from the receiving unit 2 is input to the optical modulation unit 3, the partial region feature quantity detector 6, the enlarged region feature quantity detector 8, and the whole screen feature quantity detector 4.

The optical modulation unit 3 optically modulates the illuminating light from the light emission units 5-1 to 5-N according to the image data, to form an image represented by the image data, and is formed, for example, of a transmission-type liquid crystal panel. A transmission-type liquid crystal panel has a plurality of pixels as optical modulation elements, and the light transmittance of each pixel is controlled according to the corresponding pixel value of the image data.

Figure 2:
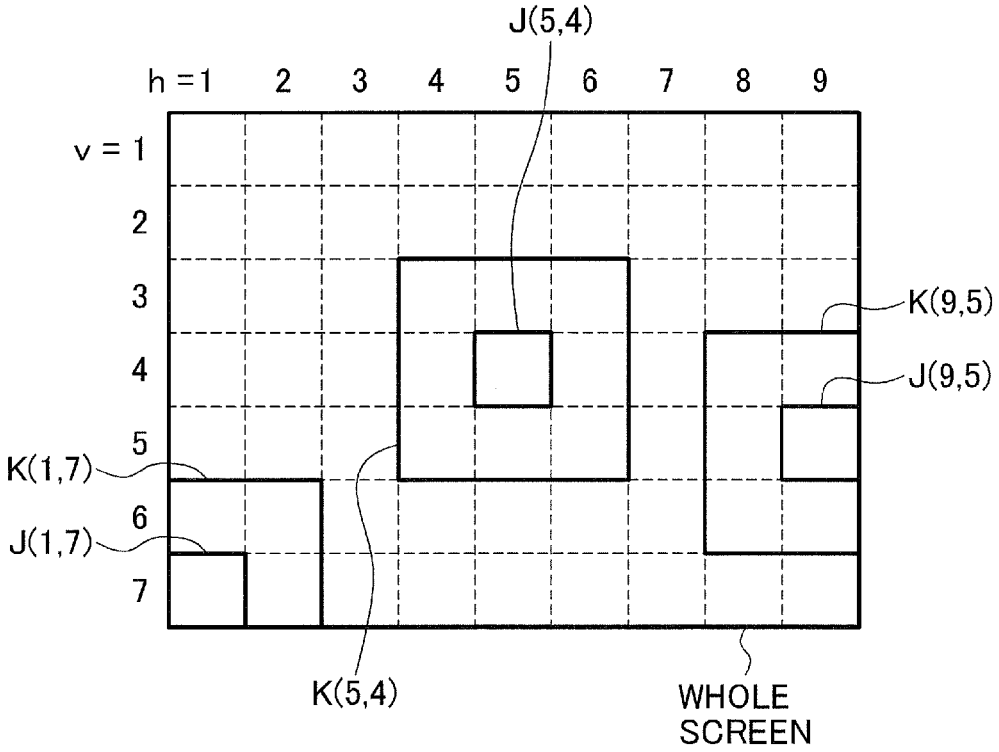
FIG. 2 is a drawing showing partial regions and enlarged regions respectively formed of parts of the optical modulation unit.

Regions or parts of the optical modulation unit 3 respectively corresponding to the light emission units 5-1 to 5-N are called divided regions or partial regions 3-1 to 3-N. Each partial region includes a plurality of pixels. "Part of the optical modulation unit 3 corresponding to each light emission unit" means a set of optical modulation pixels at which the light from the light emission unit in question is dominant, i.e., a set of pixels which receive more light from the light emission unit in question than from any of other light emission units. The optical modulation unit 3 is for example of a rectangular form corresponding to the display screen, as shown in FIG. 2, and is formed of V×H=N partial regions 3-1 to 3-N, where V (V=7 in the illustrated example) is the number of vertically aligned partial regions, and H (H=9 in the illustrated exampled) is the number of horizontally aligned partial regions.

As mentioned above, each partial region 3-n (n is any of 1 to N) of the optical modulation unit 3 corresponds to one light emission unit 5-n, and the partial region 3-n is illuminated mainly by the corresponding light emission unit 5-n. Each light emission unit 5-n is a unit of controlled object whose light emission luminance is controlled independently of other light emission units. Each light emission unit 5-n is formed of one or more light emission elements, such as light emitting diodes (LEDs).

The horizontal and vertical positions of each partial region 3-n of the optical modulation unit 3 within the display screen are represented by (h,v). In FIG. 2, h=1 for the leftmost column, and h=H for the rightmost column; and v=1 for the uppermost row, and v=V for the lowermost row. Each partial region 3-n in the optical modulation unit 3 may be denoted by J(h,v) according to the position (h,v) defined as above. Similarly, the light emission units 5-1 to 5-N may also be represented by 5(h,v) according to the position (h,v) of the corresponding partial region of the optical modulation unit.

Each partial region J(h,v) and its neighboring partial regions in combination form an enlarged region K(h,v) pertaining to the partial region J(h,v). In FIG. 2, the central partial region J(5, 4) is shown to be a partial region of interest, and its neighboring partial regions J(4, 3), J(5, 3), J(6, 3), J(4, 4), J(5, 4), J(6, 4), J(4, 5), J(5, 5), and J(6, 5) in combination form an enlarged region K(5, 4).

The number of rows or the number of columns of the partial regions forming an enlarged region may be two.

Figures 13, 14:
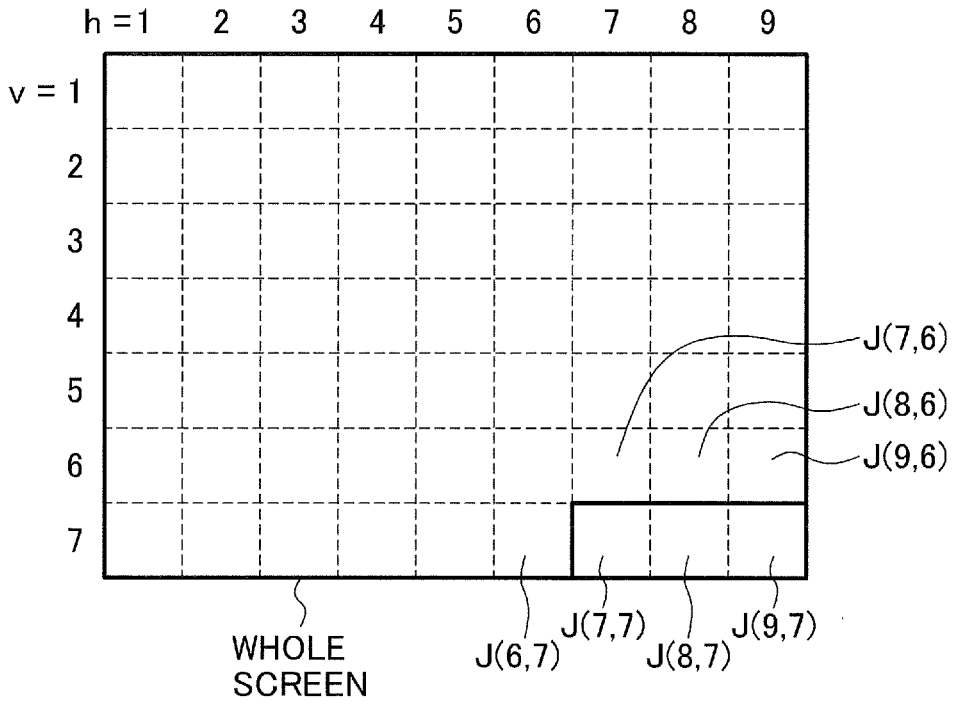
FIG. 13 is a drawing showing an example of partial region in which OSD display is made.
FIG. 14 is a drawing showing an example of arrangement of partial regions in a situation in which light emission elements are disposed along short edges of the screen.

FIG. 14 shows an example where the number of rows is eight while the number of columns is two. FIG. 15 shows an example where the number of rows is two while the number of columns is eight.

For example, the array shown in FIG. 14 is used when the light emission elements are arranged along shorter edges of the screen; while the array shown in FIG. 15 is used when the light emission elements are arranged along longer edges of the screen. In either case, each partial region corresponds to one light emission unit formed of one or more light emission elements.

In the array shown in FIG. 14, the enlarged region pertaining to each partial region (partial region of interest) is formed of partial regions belonging to the same column and the column positioned at one side of the column to which the partial region of interest belong. For instance, the enlarged region pertaining to the partial region J(1, 3) is formed of the partial regions J(1, 2), J(1, 3), and J(1, 4) in the same column, and the partial regions J(2, 2), J(2, 3), and J(2, 4) in the column adjacent to and to the right of the column to which the partial region J(1, 3) belong.

In the array shown in FIG. 15, the enlarged region pertaining to each partial region (partial region of interest) is formed of the partial regions belonging to the same row and the row positioned on one side of the row to which the partial region of interest belong. For instance, the enlarged region pertaining to the partial region J(5, 1) is formed of the partial regions J(4, 1), J(5, 1), and J(6, 1) in the same row, and the partial regions J(4, 2), J(5, 2), and J(6, 2) in the row adjacent to and below the row to which the partial region J(5, 1) belong.

As will be described in detail below, in order to control the light emission luminance of each light emission unit 5(h,v), the image display device according to the invention takes the partial region J(h,v) corresponding to the light emission unit in question (a controlled object), as a partial region of interest, and performs control on the basis of a feature quantity of the image represented by the image data used for the optical modulation in the partial region of interest, a feature quantity of the image represented by the image data used for the optical modulation in the enlarged region K(h,v) including the partial region of interest, and a feature quantity of the entire image (feature quantity of the entire screen).

The partial region feature quantity detector 6 receives the input image data Di output from the receiving unit 2, generates the feature quantity of the image represented by that part of the input image data Di which is used for the optical modulation in each J(h,v) of the partial regions of the optical modulation unit 3 (in other words, the feature quantity of the that part of the image represented by the input image data Di which is formed in the partial region J(h,v)), and outputs it as the partial region feature quantity Fa(h,v).

In the following description, the feature quantity of the image represented by the image data used for the optical modulation in each partial region may be referred simply as the "feature quantity of the image of the partial region", or the "feature quantity pertaining to the partial region".

The enlarged region feature quantity detector 8 receives the input image data Di output from the receiving unit 2, generates the feature quantity of the image represented by that part of the input image data Di which is used for the optical modulation in the enlarged region K(h,v) pertaining to each J(h,v) of the partial regions of the optical modulation unit 3 (in other words, the feature quantity of that part of the image represented by the input image data Di which is formed in the enlarged region K(h,v)), and outputs it as the enlarged region feature quantity Fb(h,v).

In the following description, the feature quantity of the image represented by the image data used for the optical modulation in each enlarged region may be referred simply as the "feature quantity of the image of the enlarged region", or the "feature quantity pertaining to the enlarged region".

In the example shown in FIG. 2, when each partial region J(h,v) is taken as a partial region of interest, an enlarged region K(h,v) pertaining to the partial region J(h,v) of interest, i.e., an enlarged region of interest, is formed of the partial region of interest itself, and the eight partial regions adjacent to the partial region of interest, and disposed to surround the partial region of interest, i.e., eight partial regions J(h−1,v−1), J(h,v−1), J(h+1,v−1), J(h−1,v), J(h+1,v), J(h−1,v+1), J(h,v+1), and J(h+1,v+1), having horizontal and vertical coordinates differing, just by one, from the corresponding coordinate of the partial region of interest. But the invention is not limited to such an arrangement. For instance, the enlarged region of may include all or part of the sixteen partial regions having a horizontal and vertical coordinate differing, just by two, from the corresponding coordinate of the partial region of interest. The shape of each enlarged region may not be symmetrical in the horizontal or vertical direction. Also, the enlarged regions may not be formed in the same manner for all the partial regions. For instance, in the case of the enlarged region pertaining to the partial region (e.g., J(9,5) in FIG. 2) positioned next to a upper, lower, leftmost, or rightmost edge of the optical modulation unit 3, or the partial region (e.g., J(1,7) in FIG. 2 positioned at a corner of the optical modulation unit 3, since no partial region is present outside the optical modulation unit 3, only the partial regions positioned inside the optical modulation unit 3 may be used as the neighboring partial regions, to form an enlarged region (K(9,5); K(1,7)) pertaining to the partial region of interest).

On the basis of the input image data Di output from the receiving unit 2, the whole screen feature quantity detector 4 detects the feature quantity of the image for the entire screen, and outputs it as the whole screen feature quantity Fc. The whole screen feature quantity includes a first whole screen feature quantity (first type of whole screen feature quantity) Fc0, and a second whole screen feature quantity (second type of whole screen feature quantity) Fc1.

Each of the feature quantities Fa(h,v), Fb(h,v), Fc0, and Fc1 is a value or index relating to the brightness of the image obtained from the pixel values forming the image data, e.g., an average value, a maximum value or a minimum value of the luminance value represented by the image data pertaining to each pixel;

a frequency of occurrence of a specified luminance value represented by the image data pertaining to each pixel;

a frequency of occurrence of a specified saturation represented by the image data pertaining to each pixel;

an average value, a maximum value or a minimum value of a color signal forming the image data pertaining to each pixel; or a combination of one or more of the above.

The partial region feature quantity Fa(h,v) pertaining to each partial region is obtained from the pixel values of the image data used for the optical modulation in the partial region in question, e.g., an average value of the pixel values of the image data used for the optical modulation in the partial region J(h,v) in question;

a peak value in the partial region J(h,v);

a frequency of occurrence of a specific value within the partial region J(h,v), which is the number of occurrences of a specific pixel value within the image data used for the optical modulation in the partial region J(h,v) in question, divided by the number of pixels of the image data used for the optical modulation in the partial region in question, or a value obtained by multiplying it by a prescribed coefficient.

The enlarged region feature quantity Fb(h,v) pertaining to each partial region is obtained from the pixel values of the image data used for the optical modulation in the enlarged region formed of the partial region in question, and its neighboring partial regions, e.g., an average of the pixel values of the image data used for the optical modulation in the enlarged region K(h,v) in question;

a peak value of the pixel values of the image data used for the optical modulation in the enlarged region K(h,v) in question;

a frequency of occurrence of a specific pixel value within the partial region J(h,v), which is the number of occurrences of a specific pixel value within the image data used for the optical modulation in the enlarged region K(h,v) in question, divided by the number of pixels of the image data used for the optical modulation in the enlarged region in question, or a value obtained by multiplying it by a prescribed coefficient.

The enlarged region feature quantity Fb(h,v) pertaining to each partial region J(h,v) of interest (the feature quantity Fb(h,v) pertaining to the enlarged region K(h,v) formed of each partial region of interest, and its neighboring partial regions) is a value obtained by uniform processing over feature quantities including the feature quantity pertaining to the partial region J(h,v) of interest. For instance, the enlarged region feature quantity Fb(h,v) pertaining to each partial region of interest is obtained on the basis of the pixel values of the pixels in the partial region J(h,v) of interest, and the pixel values of the pixels in the neighboring partial regions (i.e., partial regions positioned in the neighborhood of the partial region J(h,v) of interest), without giving weight on the pixel values. For instance, when an average value is the feature quantity, the enlarged region feature quantity Fb(h,v) pertaining to each partial region J(h,v) of interest, is an average value (simple average value), on the basis of the pixel value of the pixels in the partial region J(h,v) of interest, and without giving weight.

Each of the first and second whole screen feature quantities Fc0 and Fc1 is obtained from the pixel values of all the pixels in the screen, e.g., an average value throughout the entire screen, a peak value throughout the entire screen, a frequency of occurrence of a specific value obtained by the number of occurrences of the specific value throughout the entire screen divided by the number of pixels in the entire screen, or a value obtained by multiplying it by a prescribed coefficient.

Whether an average value, a peak value, a bottom value, or a frequency of occurrence of a predetermined luminance value is used for each partial region, is decided taking into consideration the size of the partial region. When each partial region is small, the brightness of each region can be estimated with a sufficiently high accuracy, on the basis of a peak value, a bottom value, or a frequency of occurrence of a predetermined luminance value. When each partial region is large, it is desirable to use an average value in order to increase the accuracy of estimation of the brightness.

The feature quantities Fa(h,v), Fb(h,v), and Fc1 are of the same type, among the types exemplified above. The feature quantity Fc0 may be of the same type as or of a different type from the type of the above-mentioned three classes of feature quantities. In an example in which the feature quantity Fc0 is of a different type, the feature quantities Fa(h,v), Fb(h,v), and Fc1 are peak values, and the feature quantity Fc0 is an average value of the luminance.

The partial region feature quantities Fa(h,v), the enlarged region feature quantities Fb(h,v), and the whole screen feature quantities Fc0, and Fc1 are supplied to the light-emission control data generator 7.

On the basis of the partial region feature quantity Fa(h,v) and the enlarged region feature quantity Fb(h,v) pertaining to each partial region J(h,v), and the whole screen feature quantities Fc0 and Fc1, the light-emission control data generator 7 generates light-emission control data Y(h,v) pertaining to the partial region in question.

The generated light-emission control data Y(h,v) is supplied to the light emission driver 9, and used for determining the light-emission level (luminance level) of the corresponding light emission unit 5(h,v).

On the basis of the light-emission control data Y(h,v) for each partial region, input from the light-emission control data generator 7, the light emission driver 9 generates a drive signal Q(h,v) for driving the light emission unit 5(h,v) corresponding to the partial region in question, and outputs the drive signal Q(h,v) to the light emission unit 5(h,v) in question.

The light-emission control data generator 7 and the light emission driver 9 in combination form a light emission controller 30 which controls the light emission luminance of the light emission unit corresponding to each J(h,v) of the partial regions of the optical modulation unit 3, on the basis of the partial region feature quantity Fa(h,v) and the enlarged region feature quantity Fb(h,v) pertaining to the partial region in question, and the whole screen feature quantities Fc0 and Fc1.

Figure 3:
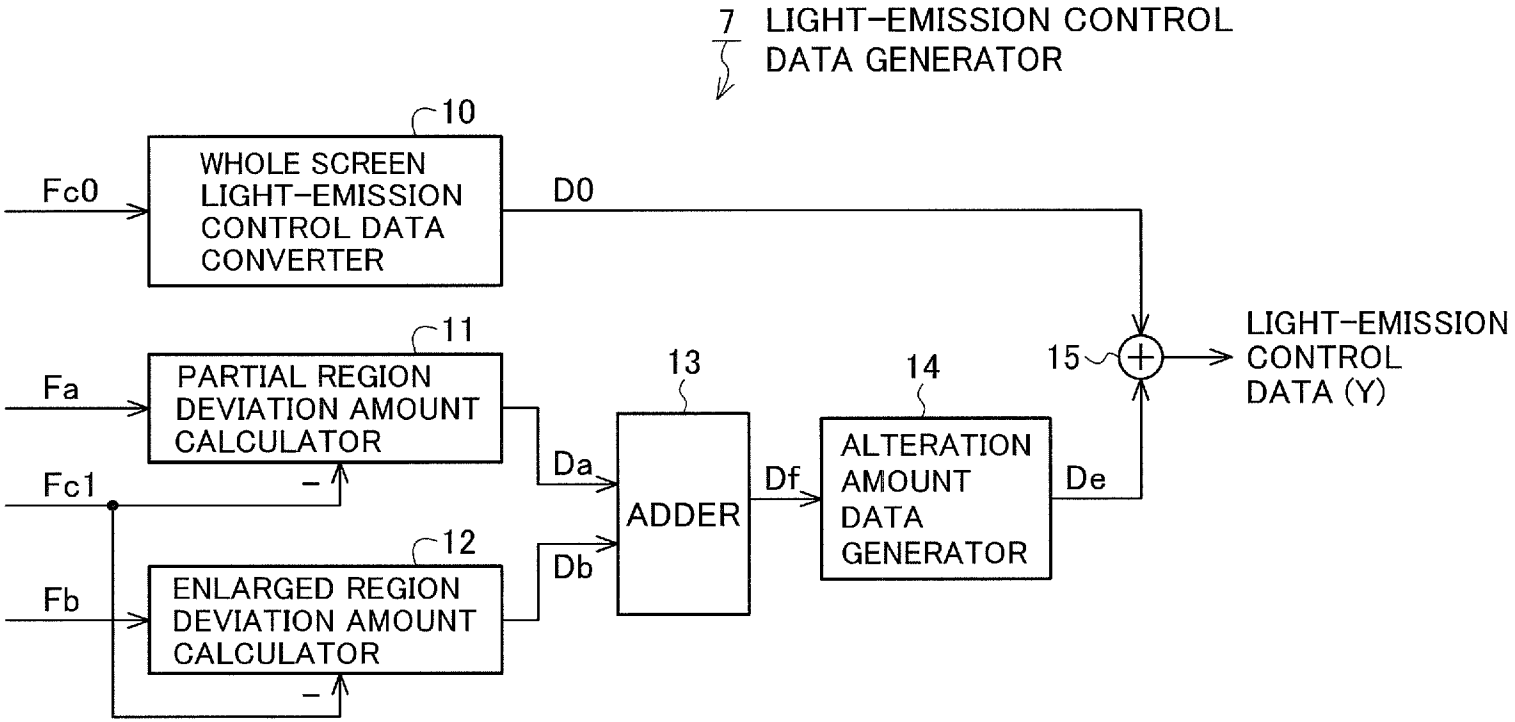
FIG. 3 is a block diagram showing an example of a light-emission control data generator 7 of FIG. 1.

FIG. 3 shows an example of configuration of the light-emission control data generator 7 shown in FIG. 1.

The illustrated light-emission control data generator 7 includes a whole screen light-emission control data converter 10, a partial region deviation amount calculator 11, an enlarged region deviation amount calculator 12, an adder 13, an alteration amount data generator 14, and an adder 15.

The first whole screen feature quantity Fc0 detected by the whole screen feature quantity detector 4 in FIG. 1 is input to the whole screen light-emission control data converter 10, and converted to whole screen light-emission control data D0, and output.

The value of the whole screen light-emission control data D0 is represented by a monotonically increasing function f(Fc0) with respect to the first whole screen feature quantity Fc0; the value D0 of the whole screen light-emission control data generally increases as the first whole screen feature quantity Fc0 increases, but restrictions are imposed in order to prevent the partial region light-emission control data Y from becoming a negative value, and from exceeding a predetermined maximum value, as described later. The value of the whole screen light-emission control data D0 is input to the adder 15.

The partial region feature quantities Fc0 detected by the partial region feature quantity detector 6 in FIG. 1, and the second whole screen feature quantity Fc1 detected by the whole screen feature quantity detector 4 in FIG. 1 are input to the partial region deviation amount calculator 11.

The partial region deviation amount calculator 11 subtracts the second whole screen feature quantity Fc1 from the partial region feature quantity Fa(h,v) pertaining to each partial region J(h,v), to output partial region deviation amount data Da(h,v) representing the difference between the second whole screen feature quantity Fc1 and the partial region feature quantity Fa(h,v). The partial region deviation amount data Da(h,v) represents a deviation amount for each partial region. The partial region deviation amount data Da output from the partial region deviation amount calculator 11 is input to the adder 13.

The enlarged region feature quantities Fb detected by the enlarged region feature quantity detector 8 in FIG. 1, and the second whole screen feature quantity Fc1 detected by the whole screen feature quantity detector 4 in FIG. 1 are input to the enlarged region deviation amount calculator 12.

The enlarged region deviation amount calculator 12 subtracts the second whole screen feature quantity Fc1 from the enlarged region feature quantity Fb(h,v) pertaining to each partial region J(h,v) (i.e., the enlarged region feature quantity quantity Fb(h,v) pertaining to the enlarged region K(h,v) corresponding to the partial region J(h,v)),) to output enlarged region deviation amount data Db(h,v) representing the difference between the second whole screen feature quantity Fc1 and the enlarged region feature quantity Fb(h,v). The enlarged region deviation amount data Db(h,v) represents a deviation amount for each enlarged region. The enlarged region deviation amount data Db output from the enlarged region deviation amount calculator 12 is input to the adder 13.

The adder 13 adds the partial region deviation amount data Da(h,v) pertaining to each partial region, and the enlarged region deviation amount data Db(h,v) pertaining to the same partial region, and outputs a result of the addition, as a local deviation amount data pertaining to the partial region in question.

The local deviation amount data Df output from the adder 13 is input to the alteration amount data generator 14, and converted to luminance alteration amount data De for each partial region, and output.

The value of the luminance alteration amount data De is represented by a monotonically increasing function g(Df) with respect to the local deviation amount data Df; the value of the luminance alteration amount data De generally increases as Df increase, but restrictions are imposed to prevent the partial region light-emission control data Y from becoming a negative value, and from exceeding a predetermined maximum value, as described later. The luminance alteration amount data De is input to the adder 15.

The adder 15 adds the input whole screen light-emission control data D0, and the input luminance alteration amount data De(h,v) pertaining to each partial region, and outputs light-emission control data Y(h,v) (=D0+De(h,v)) pertaining to the partial region in question.

The whole screen light-emission control data D0 corresponds to a value of a certain feature quantity obtained from the entire screen, or an average or the like throughout the entire screen, and is also called a "DC component". In contrast, the luminance alteration amount data De(h,v) corresponds to the difference or deviation amount of the feature quantity in question determined for each partial region, from the average value throughout the entire screen, and is also called an "AC component".

The data corresponding to the deviation amount (AC component) for each partial region contributes both to the improvement in the dynamic range of the display, and reduction or suppression of the black offset, while the data corresponding to the average value (DC component) throughout the entire screen serves to lower, as much as possible, the luminance of the entire screen, and has an effect of suppressing the black offset.

In the following description, it is assumed that the partial region feature quantities Fa, and the enlarged region feature quantities Fb, and the first and second whole screen feature quantities Fc0 and Fc1 are all average luminance values of an image, and hence Fc0=Fc1, and explanation is made on the average luminance value Fa(h,v) for each partial region detected by the partial region feature quantity detector 6, the average luminance value Fb(h,v) for each enlarged region detected by the enlarged region feature quantity detector 8, the partial region deviation amount data Da(h,v) calculated by the partial region deviation amount calculator 11, the enlarged region deviation amount data Db(h,v) calculated by the enlarged region deviation amount calculator 12, and the local deviation amount data Df(h,v) determined by the adder 13, with respect to some examples of images. In the following examples, the optical modulation unit 3 corresponding to the entirety of the display screen consists of five-by-five (25) partial regions, and the coordinates (h,v) of each partial region is represented by (1,1) to (5,5).

In the example shown in FIG. 4(*a*), a high-luminance part is present only at the center of the image, and the average luminance value Fa(3,3) of the image represented by the image data used for the optical modulation in the partial region at the center is "40", while the average luminance value Fa(h,v) (h=1 to 5, v=1 to 5, excluding the case where h=3 and v=3) of the image represented by the image data used for the optical modulation in each of other partial regions is "0". The average luminance value Fb(h,v) of the image represented by the image data used for the optical modulation in the enlarged region pertaining to each partial region (h,v) is as shown in FIG. 4(*b*).

The value of the average luminance (Fc0=Fc1) throughout the entire screen, used as the first and second whole screen feature quantities, is "2" when calculated and rounded off to an integer (by rounding down four and rounding up five).

The partial region deviation amount data Da(h,v) obtained by subtracting the whole screen average luminance value Fc1(=Fc0) from the partial region average luminance values Fa(h,v) shown in FIG. 4(*a*) are as shown in FIG. 4(*c*). The luminance difference in the partial region deviation amount data Da (h,v) thus obtained, between the central partial region and each of the adjacent partial regions is not suppressed.

The enlarged region deviation amount data Db (h,v) obtained by subtracting the whole screen average luminance value Fc1(=Fc0) from the enlarged region average luminance values Fb(h,v) shown in FIG. 4(*b*) are as shown in FIG. 4(*d*). The luminance differences in the enlarged region deviation amount data Db(h,v) shown in FIG. 4(*d*) between adjacent partial regions are suppressed, but the high luminance part at the center is not enhanced.

The local deviation amount data Df (h,v) obtained by adding the partial region deviation amount data Da(h,v) in FIG. 4(*c*) and the enlarged region deviation amount data Db(h,v) in FIG. 4(*d*) are as shown in FIG. 4(*e*). The high luminance part at the center is enhanced, and the luminance differences between adjacent partial regions are suppressed.

In the example shown in FIG. 5(*a*), high luminance parts are present at the center and four corners of the image; the average luminance value Fa(3,3) of the image represented by the image data used for the optical modulation in the central partial region is "40", the average luminance value Fa(1,1) of the image represented by the image data used for the optical modulation in the partial region at the upper left corner is "25", the average luminance value Fa(5,1) of the image represented by the image data used for the optical modulation in the partial region at the upper right corner is "30", the average luminance value Fa(1,5) of the image represented by the image data used for the optical modulation in the partial region at the lower left corner is "35", the average luminance value Fa(5,5) of the image represented by the image data used for the optical modulation in the partial region at the lower right corner is "40", and the average luminance values Fa(h,v) of the image represented by the image data used for the optical modulation in other partial regions are "0". The average luminance value Fb(h,v) of the image represented by the image data used for the optical modulation of the enlarged region pertaining to each partial region (h,v) is as shown in FIG. 5(*b*).

The value of the average luminance (Fc0=Fc1) throughout the entire screen, used as the first and second whole screen feature quantities, is "7" when calculated and round off to an integer (by rounding down four and rounding up five).

The partial region deviation amount data Da(h,v) obtained by subtracting the whole screen average luminance value Fc1(=Fc0) from the partial region average luminance values Fa(h,v) shown in FIG. 5(*a*) are as shown in FIG. 5(*c*). The luminance difference in the partial region deviation amount data Da (h,v) thus obtained, between each of the partial regions at the center and the four corners, and each of the partial regions adjacent to them is not suppressed.

The enlarged region deviation amount data Db(h,v) obtained by subtracting the whole screen average luminance value Fc1(=Fc0) from the enlarged region average luminance values Fb(h,v) shown in FIG. 5(*b*) are as shown in FIG. 5(*d*). The luminance differences in the enlarged region deviation amount data Db(h,v) shown in FIG. 5(*d*) between adjacent partial regions are suppressed, but the high luminance parts at the center and the four corners are not enhanced.

The local deviation amount data Df(h,v) obtained by adding the partial region deviation amount data Da(h,v) in FIG. 5(*c*) and the enlarged region deviation amount data Db(h,v) in FIG. 5(*d*) are as shown in FIG. 5(*e*). The high luminance parts at the center and the four corners are enhanced, and the luminance differences between adjacent partial regions are suppressed.

In the example shown in FIG. 6(*a*), high luminance parts are present at the center of the image and at positions diagonally upward and diagonally downward with respect to the center; the average luminance value Fa(3,3) of the image represented by the image data used for the optical modulation in the central partial region is "40", the average luminance value Fc0(2,2) of the image represented by the image data used for the optical modulation in the partial region to the upper left of the center is "25", the average luminance value Fc0(4,2) of the image represented by the image data used for the optical modulation in the partial region to the upper right of the center is "30", the average luminance value Fc0(2,4) of the image represented by the image data used for the optical modulation in the partial region to the lower left of the center is "35", the average luminance value Fa(4,4) of the image represented by the image data used for the optical modulation in the partial region to the lower right of the center is "40", and the average luminance values Fa(h,v) of the image represented by the image data used for the optical modulation in other partial regions are "0". The average luminance value Fb(h,v) of the image represented by the image data used for the optical modulation of the enlarged regions pertaining to each partial region (h,v) is as shown in FIG. 6(*b*).

The value of the average luminance (Fc0=Fc1) throughout the entire screen, used as the first and second whole screen feature quantities, is "7" when calculated and rounded off to an integer (by rounding down four and rounding up five).

The partial region deviation amount data Da(h,v) obtained by subtracting the whole screen average luminance value Fc1(=Fc0) from the partial region average luminance values Fa(h,v) shown in FIG. 6(*a*) are as shown in FIG. 6(*c*). The luminance difference in the partial region deviation amount data Da(h,v)thus obtained, between each of the partial regions at the center and positions diagonally upward and diagonally downward with respect to the center, and each of the partial regions adjacent thereto is not suppressed.

The enlarged region deviation amount data Db(h,v) obtained by subtracting the whole screen average luminance value Fc1=Fc0 from the enlarged region average luminance values Fb(h,v) shown in FIG. 6(*b*) are as shown in FIG. 6(*d*). The luminance differences in the enlarged region deviation amount data Db(h,v) shown in FIG. 6(*d*) between adjacent partial regions are suppressed, but the high luminance parts at the center and positions diagonally upward and diagonally downward with respect to the center are not enhanced.

The local deviation amount data Df(h,v) obtained by adding the partial region deviation amount data Da(h,v) in FIG. 6(*c*) and the enlarged region deviation amount data Db(h,v) in FIG. 6(*d*) are as shown in FIG. 6(*e*). The high luminance parts at the center and positions diagonally upward and diagonally downward with respect to the center are enhanced, and the luminance differences between adjacent partial regions are suppressed.

By determining luminance alteration amount data De(h,v) for each partial region, from the local deviation amount data Df(h,v) for each partial region thus obtained, and adding the luminance alteration amount data De(h,v) to the whole screen light-emission control data D0 obtained by conversion from the whole screen feature quantity Fc0 to generate light-emission control data Y(h,v) for each partial region, the light emission luminance of the light emission unit 5(h,v) corresponding to the partial region is controlled, on the basis of the light-emission control data Y(h,v).

As a result, the luminance differences between partial regions can be suppressed while the high luminance parts are enhanced. Accordingly, the dynamic range can be widened, and black offset can be suppressed.

In this way, data for the whole screen light emission for suppressing the black offset in a dark screen, and realizing sparkling white in a bright screen, is prepared in advance by utilizing the whole screen feature quantity. The light emission luminance of the light emission unit corresponding to the partial region of interest is altered using the local deviation amount data obtained from the deviation of the partial region feature quantity of the partial region of interest, and the deviation of the enlarged region feature quantity pertaining to the partial region of interest. The data for the whole screen light-emission is prepared in advance on the basis of the whole screen feature quantity which is not associated with variations in the light emission luminance between the partial regions (between the light emission units corresponding to the partial regions). The local deviation amount data of a level with which the difference in the light emission luminance between regions is non-perceptible, are added to the data for the whole screen light emission which is used as a basis. This process makes it easy to suppress, to non-perceptible level, the difference in the light emission luminance between regions.

When the local deviation amount data having such a level with which the difference in the light emission luminance between regions is not perceptible are added, to the data for the whole screen light emission, the bright regions emit light so as to realize sparkling white. The dynamic range of the light emission luminance can thereby be increased.

Moreover, the light emission luminance based on the whole screen feature quantity is altered by using the feature quantity of the partial region of interest, and the feature quantity of the enlarged region including the partial region of interest. Because the features of the periphery to the partial region of interest is taken into consideration, it is possible to obtain the effect of weighting using the correlation with the neighboring regions, while attaching importance to the partial region of interest.

The process of weighting information from the partial regions involves complicated processes of obtaining the positional relation or distance information from other partial regions. Moreover, because there is no correlation between the information from one region and information from another region, more complicated processes are required for the weighting. The invention eliminates the need for such complicated processing for the weighting, and can be implemented by simple processes and by simple hardware configuration.

Embodiment 2

Figure 7:
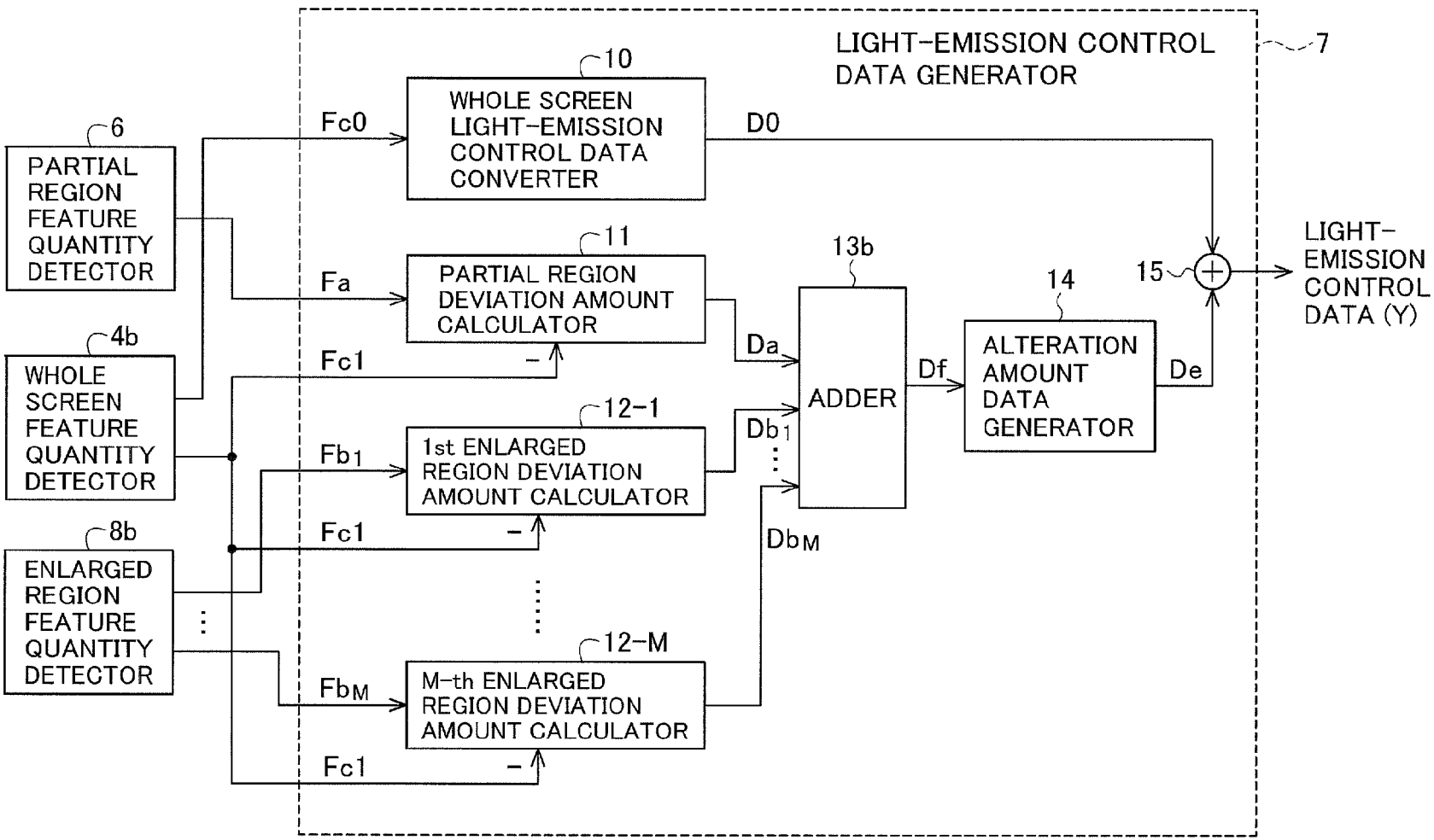
FIG. 7 is a drawing showing an example of configuration of a light-emission control data generator 7 used in Embodiment 2 of the present invention.

FIG. 7 shows a light-emission control data generator 7, a partial region feature quantity detector 6, an enlarged region feature quantity detector 8*b*, and a whole screen feature quantity detector 4*b* used in the image display device of Embodiment 2 of the present invention.

The light-emission control data generator 7 shown in FIG. 7 sets, for each partial region, enlarged regions differing in size from each other, so as to further reduce the luminance differences between adjacent partial regions, and includes a whole screen light-emission control data converter 10, a partial region deviation amount calculator 11, a first to M-th enlarged region deviation amount calculators 12-1 to 12-M, an adder 13*b*, an alteration amount data generator 14, and an adder 15. In FIG. 7, the reference numerals identical to those in FIG. 3 denote blocks of identical functions.

The enlarged region feature quantity detector 8*b* receives the input image data Di output from the receiving unit 2, and sets, for each J(h,v) of the partial regions of the optical modulation unit 3, a first to M-th (M being an integer greater than 1) enlarged regions $K_1(h,v)$ to $K_M(h,v)$ including the partial region J(h,v), and outputs the feature quantities $Fb_1(h,v)$ to $Fb_M(h,v)$ of the image of the respective enlarged regions.

The first enlarged region $K_1(h,v)$ is, for instance, identical to the enlarged region K(h,v) in Embodiment 1. The second enlarged region $K_2(h,v)$ is larger than the first enlarged region $K_1(h,v)$, and includes the first enlarged region $K_1(h,v)$ and one or more partial regions neighboring the enlarged region $K_1(h,v)$. To generalize, the m-th (m being any of 2 to M) enlarged region $K_m(h,v)$ is larger than the (m−1) -th enlarged region $K_{m-1)}(h,v)$, and includes the (m−1) -th enlarged region and one or more partial regions neighboring the (m−1)-th enlarged region.

Figure 8:
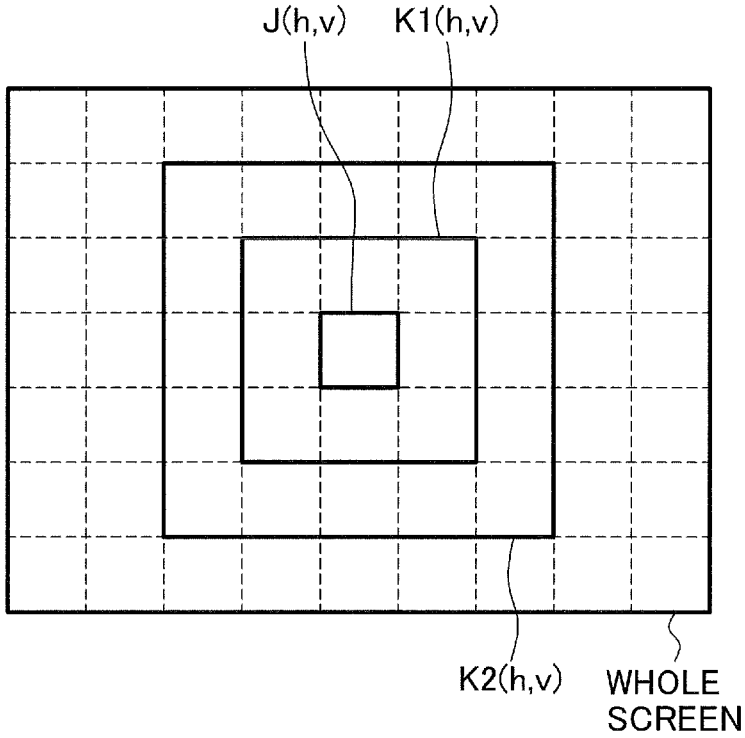
FIG. 8 is a drawing showing an example of partial regions and enlarged regions forming parts of the optical modulation unit 3 in Embodiment 2 of the present invention.

FIG. 8 shows a first enlarged region $K_1(h,v)$ and a second enlarged region $K_2(h,v)$, for a case where M=2. In the example shown in FIG. 8, the first enlarged region $K_1(h,v)$ is formed in the same way as the enlarged region K(5, 4) in FIG. 2, and the second enlarged region $K_2(h,v)$ includes the first enlarged region $K_1(h,v)$, and also includes sixteen (16) partial regions neighboring and positioned to surround the first enlarged region $K_1(h,v)$.

When M=2 as in the array of FIG. 14, the first and second enlarged regions pertaining to each partial region (partial region of interest) are formed of partial regions belonging to the same column as the partial region of interest, and the column disposed on one side of the column to which the partial region of interest belong. For instance, the first enlarged region pertaining to the partial region J(1, 3) is formed of the partial regions J(1,2), J(1,3), J(1,4) in the same column, and the partial regions J(2,2), J(2,3), J(2,4) in the column positioned next to and to the right of the column to which the partial region of interest belongs; the second enlarged region is formed of the partial regions J(1,1), J(1,2), J(1,3), J(1,4), J(1,5) in the same column, and the partial regions J(2,1), J(2,2), J(2,3), J(2,4), J(2,5 in the column positioned next to and to the right of of the column to which the partial region of interest belongs.

In this way, the second enlarged region pertaining to each partial region of interest is expanded, relative to the first enlarged region pertaining to the same partial region of interest, only within the same columns.

When M=2 as in the array of FIG. 15, the first and second enlarged regions pertaining to each partial region (partial region of interest) are formed of partial regions belonging to the same row as the partial region of interest, and the row disposed to one side of the row to which the partial region of interest belong. For instance, the first enlarged region pertaining to the partial region J(5,1) is formed of the partial regions J(4,1), J(5,1), J(6,1) in the same row, and the partial regions J(4,2), J(5,2), J(6,2) in the row positioned next to and below the row to which the partial region of interest belong; the second enlarged region is formed of the partial regions J(3,1), J(4,1), J(5,1), J(6,1), J(7,1) in the same row, and the partial regions J(3,2), J(4,2), J(5,2), J(6,2), J(7,2) in the row positioned next to and below the row to which the partial region of interest belong.

In this way, the second enlarged region pertaining to each partial region of interest is expanded, relative to the first enlarged region pertaining to the same partial region of interest, only with in the same rows.

The enlarged region feature quantity detector 8*b* in the present embodiment may be said to output, for each partial region, the feature quantities pertaining to the plurality of enlarged regions $K_1(h,v)$ to $K_M(h,v)$ which are expanded to form a hierarchical structure.

The m-th enlarged region feature quantity $Fb_m(h,v)$ (the feature quantity of the image of the m-th enlarged region $K_m(h,v)$ pertaining to each partial region J(h,v) of interest) is obtained by uniform processing over feature quantities including the feature quantity pertaining to the (m−1)-th enlarged region $K_{(m-1)}(h,v)$ pertaining to the partial region J(h,v) of interest.

For instance, the m-th enlarged region feature quantity $Fb_m(h,v)$ pertaining to each partial region J(h,v) of interest is obtained, on the basis of the pixel values of the pixels within the (m−1)-th enlarged region $K_{(m-1)}(h,v)$ pertaining to the partial region J(h,v) of interest, and the neighboring partial regions (the partial regions positioned in the m-th enlarged region $K_m(h,v)$ and neighboring the (m−1)-th enlarged region $K_{(m-1)}(h,v)$), and without weighting the pixel values. For instance, when the feature quantities are average values, the m-th enlarged region feature quantity $Fb_m(h,v)$ pertaining to each partial region J(h,v) of interest is an average value (simple average value) obtained on the basis of the pixel values of the pixels in the (m−1)-th enlarged region $K_{(m-1)}(h,v)$, and the neighboring partial regions, without weighting.

The whole screen feature quantity detector 4*b* detects and outputs the first and second whole screen feature quantities Fc0 and Fc1 for the entire screen, on the basis of the input image data Di output from the receiving unit 2.

The first to M-th enlarged region deviation amount calculators 12-1 to 12-M respectively determine the differences between the first to M-th enlarged region feature quantities $Fb_1(h,v)$ to $Fb_M(h,v)$, pertaining to the first to M-th enlarged regions $K_1(h,v)$ to $K_M(h,v)$, and the second whole screen feature quantity Fc1, and outputs the first to M-th enlarged region deviation amount data $Db_1(h,v)$ to $Db_M(h,v)$.

The first to M-th enlarged region deviation amount data $Db_1(h,v)$ to $Db_M(h,v)$ output from the first to M-th enlarged region deviation amount calculators 12-1 to 12-M are all input to the adder 13*b*, which adds them to the partial region deviation amount data Da(h,v) to produce the local deviation amount data Df(h,v).

The alteration amount data generator 14 generates the luminance alteration amount data De(h,v) on the basis of the local deviation amount data Df(h,v) from the adder 13*b*.

In this way, the deviation amount data $Db_1(h,v)$ to $Db_M(h,v)$ output from the first to M-th enlarged region deviation amount calculators 12-1 to 12-M are all input to the adder 13*b*, and are used for the generation of the luminance alternation data De(h,v) at the alteration amount data generator 14.

By using the deviation amount data $Db_1(h,v)$ to $Db_M(h,v)$ of the enlarged regions $K_1(h,v)$ to $K_M(h,v)$ which are expanded to form a hierarchical structure for the generation of the luminance alteration amount data De(h,v), it is possible to vary the light emission luminance of the light emission unit stepwise (a little by little), over a wide span, and the light emission luminance differences between adjacent partial regions can be made smaller, and are made less perceptible.

Incidentally, it is explained that the value of the whole screen light-emission control data D0 is represented by a monotonically increasing function f(Fc0) with respect to the first whole screen feature quantity Fc0, and the value of luminance alteration amount data De is represented by a monotonically increasing function g(Df) with respect to the local deviation amount data Df. This assumes that the luminance of the light emission unit is increased together with the increase of the value of the light-emission control data Y(h,v), e.g., the value of the light-emission control data Y(h,v) corresponds to the ON-time where the light emission unit is pulse-width controlled. When, for instance, the value of the light-emission control data Y(h,v) corresponds to the OFF-time, the value of the light-emission control data Y(h,v) is decreased in order to increase the luminance. In such a case, the value of the whole screen light-emission control data D0, and the value of the luminance alteration amount data De need to be made smaller when the value of the desired luminance is increased. In such a case, the whole screen light-emission control data D0 having a value represented by a monotonically decreasing function f(Fc0) with respect to the first whole screen feature quantity Fc0 is used, and the luminance alteration amount data De having a value represented by a monotonically decreasing function g(Df) with respect to the local deviation amount data Df is used. Moreover, as when a value represented by a monotonically increasing function is used, restrictions are imposed so as to prevent the partial region light-emission control data Y from having a negative value, or from exceeding a prescribed maximum value.

Embodiment 3

Figure 9:
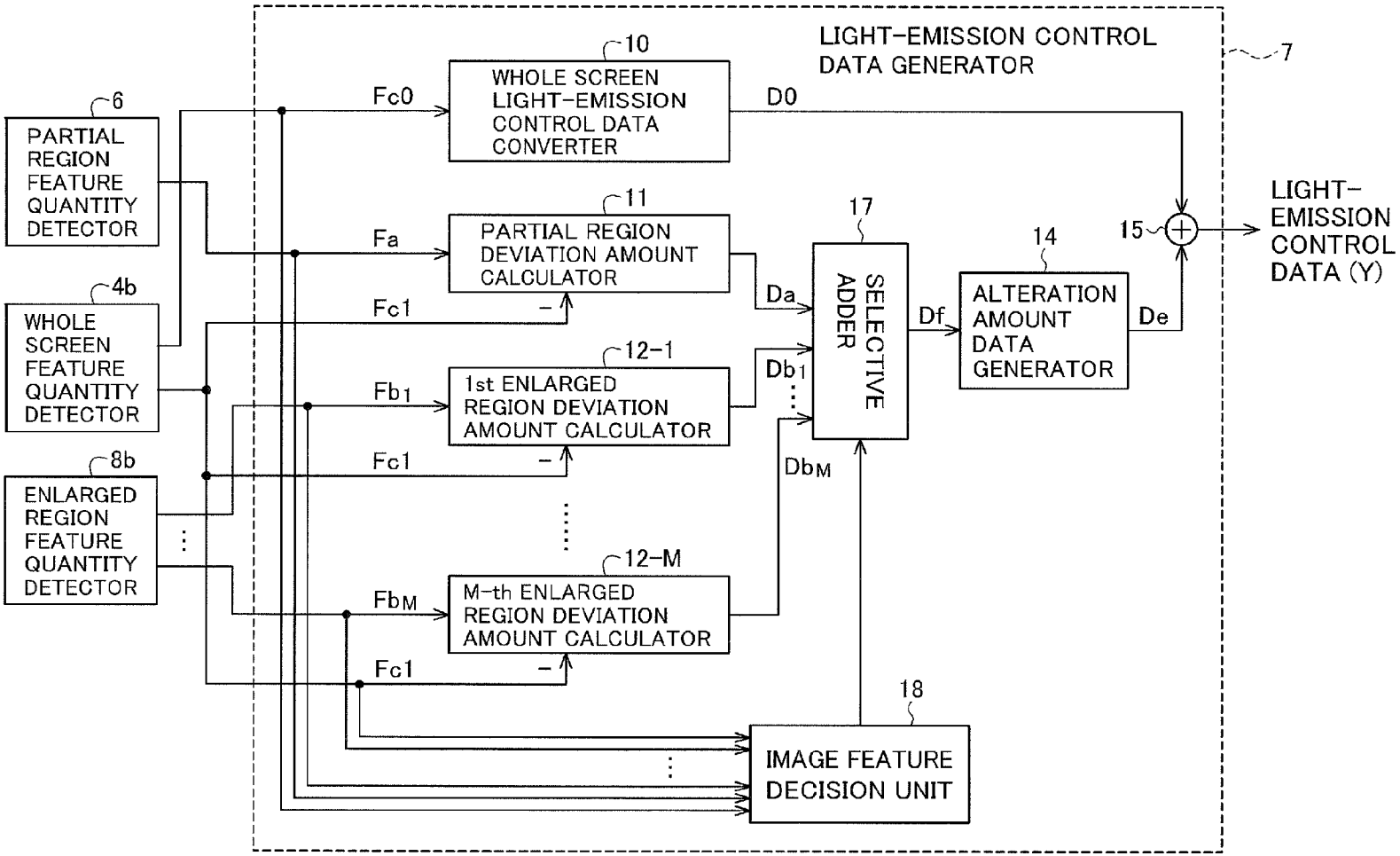
FIG. 9 is a drawing showing an example of a light-emission control data generator 7 used in Embodiment 3 of the present invention.

FIG. 9 shows a light-emission control data generator 7, and a partial region feature quantity detector 6, an enlarged region feature quantity detector 8*b*, and a whole screen feature quantity detector 4*b* used in the image display device of Embodiment 3 of the present invention.

Like Embodiment 2, the light-emission control data generator 7 shown in FIG. 9 sets, for each partial region, a plurality of enlarged regions of different sizes, but differs from Embodiment 2 in that it selects the enlarged regions responsive to the feature of the image, and utilizes the selected enlarged regions, and includes a whole screen light-emission control data converter 10, a partial region deviation amount calculator 11, a first to M-th enlarged region deviation amount calculators 12-1 to 12-M, an image feature decision unit unit 18, a selective adder 17, an alteration amount data generator 14, and an adder 15. In FIG. 9, the reference numerals identical to those in FIG. 3 or FIG. 7 denote blocks of identical functions.

The image feature decision unit 18 receives the partial region feature quantities Fa, the first to M-th enlarged region feature quantities $Fb_1$ to $Fb_M$, the first and second whole screen feature quantities Fc0 and Fc1, and makes a decision on the feature of the image.

The selective adder 17 selectively adds some or all of the enlarged region deviation amount data $Db_1(h,v)$ to $Db_M(h,v)$ on the basis of the result of the decision at the image feature decision unit 18. By such selective addition, the selective adder 17 determines the number of layers of the enlarged regions used for the generation of the luminance alteration amount data De(h,v).

When, for instance, the image has a high luminance only in one part, that is, only at a part represented by the image data used for the optical modulation in one partial region, among a plurality of partial regions J(1, 1) to J(H, V), the image feature decision unit 18 detects such a fact from the feature quantities Fa, Fb, Fc0, and Fc1, in particular from the feature quantities Fa.

The result of the decision by the image feature decision unit 18 is input to the selective adder 17, which is then controlled to add a greater number of the enlarged region deviation data. For instance, in the situation just described, all of the enlarged region deviation amount data $Db_1(h,v)$ to $Db_M(h,v)$ are added.

With such an arrangement, the light emission luminance of the corresponding light emission unit is varied stepwise (a little by little) from the partial region corresponding to the high luminance part of the image, to the partial regions far from the partial region corresponding to the high luminance part, and the difference in the light emission luminance of the corresponding light emission unit is made smaller between adjacent partial regions, and the luminance difference of the image between adjacent partial regions can be made less perceptible.

When, on the other hand, the image has generally uniform luminance, the image feature decision unit 18 detects such a fact from the feature quantities Fa, Fb, Fc0, and Fc1, in particular from the feature quantities Fa. The result of the decision by the image feature decision unit 18 is input to the selective adder 17, which then selects only part of the input deviation amount data $Db_1(h,v)$ to $Db_M(h,v)$.

For instance, it selects and adds only the first enlarged region deviation amount data $Db_1(h,v)$. Alternatively, it may select and add the first to L-th (L<M) enlarged region deviation amount data $Db_1(h,v)$ to $Db_L(h,v)$, among the first to M-th enlarged region deviation amount data $Db_1(h,v)$ to $Db_M(h,v)$. For instance, it may select and add the (s+1×t)-th, the (s+2×t)-th, the (s+3×t)-the . . . enlarged region deviation amount data (s being a predetermined integer not smaller than 0, t being a predetermined integer not smaller than 2). By selectively adding the enlarged region deviation amount data as described, it is possible perform the processing with reduced processing time or reduced power consumption.

Together with the process of selecting the enlarged regions added at the selective adder 17, it is possible to stop the process of difference calculation at the deviation calculators (part of the calculators 12-1 to 12-M) which otherwise output the deviation amount data which are not used for the addition.

In such a case, the output of the image feature decision unit 18 is supplied to the deviation amount calculators 12-1 to 12-M for the control.

Embodiment 4

Figure 10:
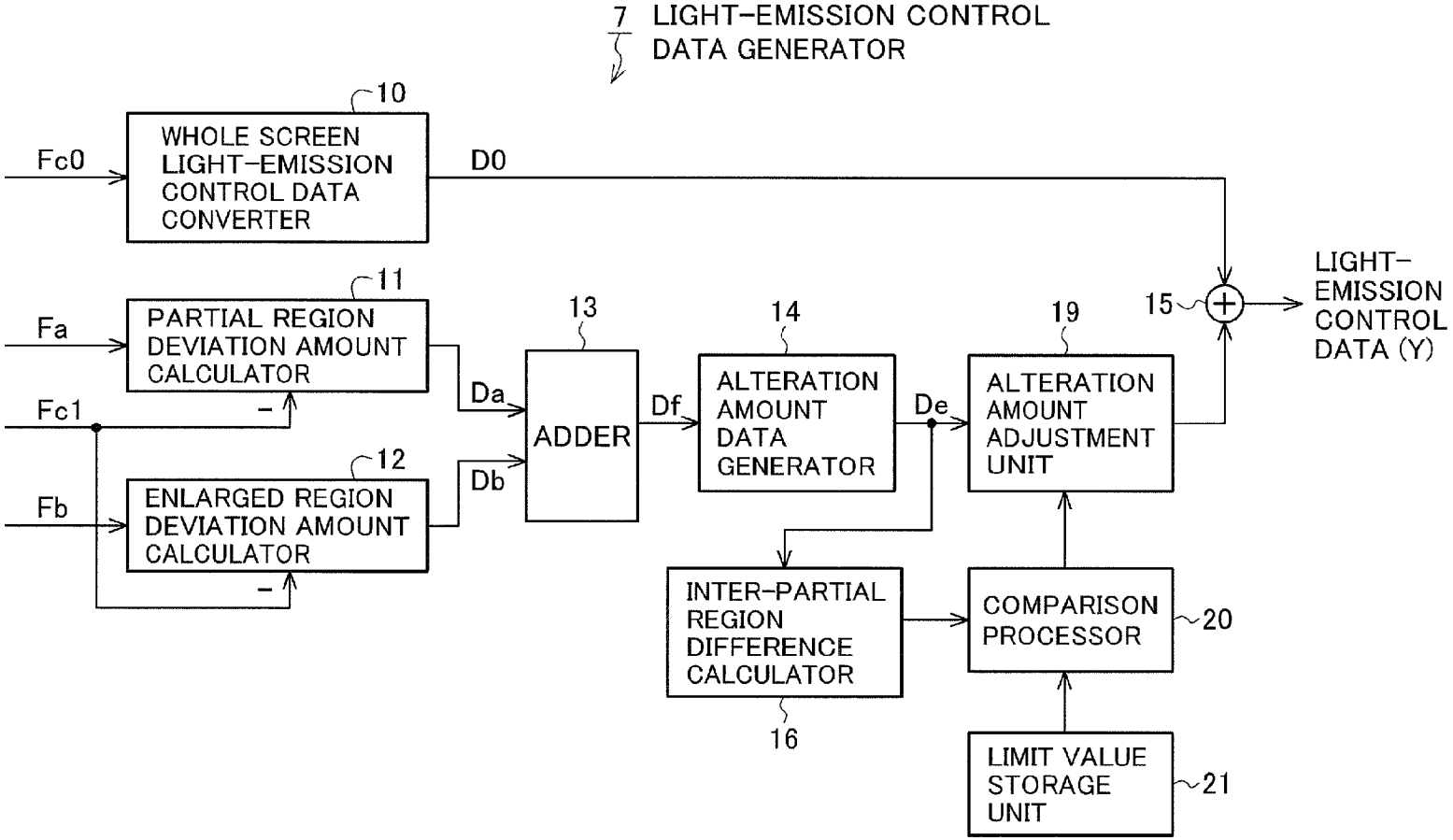
FIG. 10 is a drawing showing an example of a light-emission control data generator 7 used in Embodiment 4 of the present invention.

FIG. 10 shows the light-emission control data generator 7 used in the image display device according to Embodiment 4 of the present invention. The light-emission control data generator 7 shown in FIG. 10 performs adjustment of the luminance alteration amount data when the difference in the luminance alteration amount data between adjacent partial regions exceeds a prescribed permissible limit value, and includes a whole screen light-emission control data converter 10, a partial region deviation amount calculator 11, an enlarged region deviation amount calculator 12, an adder 13, an alteration amount data generator 14, an inter-partial region difference calculator 16, a limit value storage unit 21, a comparison processor 20, an alteration amount adjustment unit 19, and an adder 15. In FIG. 10, the reference numerals identical to those in FIG. 3, FIG. 7, or FIG. 9 denote blocks having identical functions.

The inter-partial region difference calculator 16 receives the luminance alteration amount data for each partial region (for each light emission unit) generated by the alternation data generator 14, calculates the difference in the luminance alteration amount between adjacent partial regions (between light emission units), and outputs the difference to the comparison processor 20.

The limit value storage unit 21 stores the permissible limit value. The permissible limit value is to limit the luminance difference between adjacent partial regions (between light emission units). When the difference between adjacent partial regions (between light emission units) in the luminance alteration amount calculated by the inter-partial region difference calculator 16 exceeds the permissible limit value stored in the limit value storage unit 21, the comparison processor 20 supplies information indicating such a fact, and the degree by which the permissible limit value is exceeded, to the alteration amount adjustment unit 19.

On the basis of the information from the comparison processor 20, the alteration amount adjustment unit 19 adjusts the luminance alteration amount data from the alteration amount data generator 14. Superficially, the luminance alteration amount of each of the pair of adjacent partial regions (partial adjacent pair), between which the difference exceeds the permissible limit, is altered to approach the luminance alteration amount of the other partial region of the pair, so that the difference in the luminance alteration amount between these two partial regions becomes not larger than the permissible limit value.

In this case, both of the luminance alteration amounts for the respective ones of the adjacent partial regions may be altered, or only one of the luminance alteration amounts may altered. When just one of the luminance alteration amount is altered, an average value of the luminance alternation amounts for all the partial regions in the entire screen is determined, and one of the luminance alteration amounts which has a greater difference from the average value may be altered.

When both are altered, they may be altered to the same degree, or the luminance alteration amount having a greater difference from the above-mentioned average value (average value of the luminance alteration amounts of all the partial regions within the display screen) may be altered to a greater degree.

Incidentally, the permissible limit value varies depending on the characteristics of the optical modulation unit 3, so that it may be determined through measurements performed in a state in which the light emission units 5-1 to 5-N and the optical modulation unit 3 are assembled, and the determined permissible limit value may be stored in the limit value storage unit 21.

By adding the alteration amount adjustment unit 19 to the configuration in which the partial region deviation amount data Da and the enlarged region deviation amount data Db are used in order to suppress the luminance difference between adjacent partial regions, the luminance difference between adjacent partial regions can be suppressed (prevented from exceeding), and the improvement in the dynamic range can be accomplished.

Embodiment 5

Figure 11:
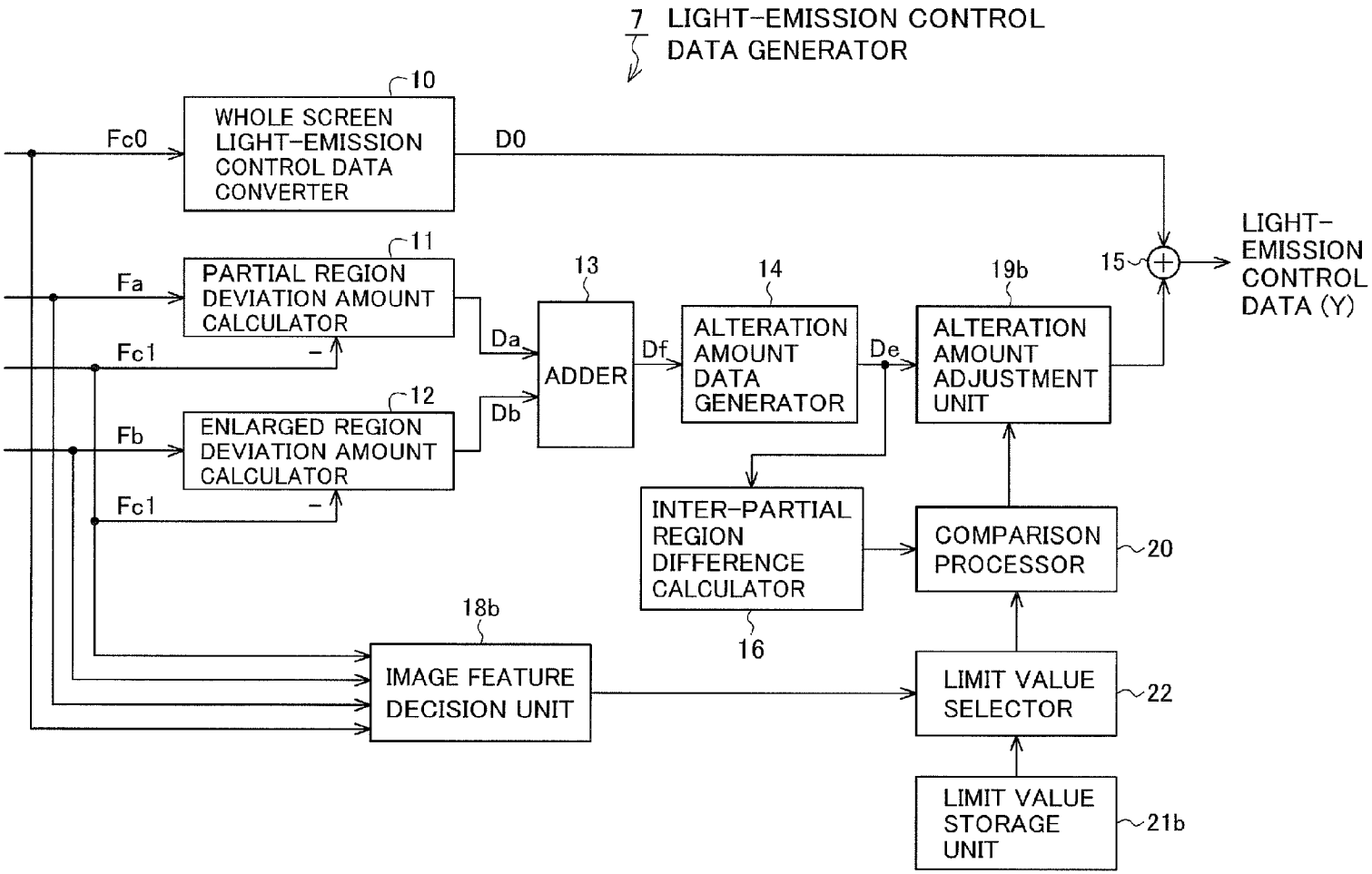
FIG. 11 is a drawing showing an example of a light-emission control data generator 7 used in Embodiment 5 of the present invention.

FIG. 11 shows a light-emission control data generator 7 used in the image display device of Embodiment 5 of the present invention. The light-emission control data generator 7 shown in FIG. 11 adjusts the luminance alteration amount data when the difference in the luminance alteration amount between adjacent partial regions (between adjacent light emission units) exceeds a predetermined permissible limit value, as in Embodiment 4, but differs from Embodiment 4, in that it sets a plurality of permissible limit values in advance, and selectively uses the permissible limit value responsive to the feature of the image, and includes a whole screen light-emission control data converter 10, a partial region deviation amount calculator 11, an enlarged region deviation amount calculator 12, an adder 13, an alteration amount data generator 14, an inter-partial region difference calculator 16, an image feature decision unit 18*b*, a limit value storage unit 21*b*, a limit value selector 22, a comparison processor 20, an alteration amount adjustment unit 19, and an adder 15.

In FIG. 11, the reference numerals identical to those in FIG. 3, FIG. 7, FIG. 9, or FIG. 10 denote blocks of identical functions.

The limit value storage unit 21*b* is similar to the limit value storage unit 21 in FIG. 10, but stores a plurality of permissible limit values.

The image feature decision unit 18*b* makes a decision on the feature of the image and outputs the result of the decision, like the image feature decision unit 18 in Embodiment 3.

The limit value selector 22 is responsive to the result of the decision by the image feature decision unit 18*b*, and selects one of the permissible limit values stored in the limit value storage unit 21*b*, and outputs the selected permissible limit value.

The perceptibility of the luminance difference between adjacent partial regions depends on the feature of the image. For instance, due to the characteristics of visual sense, the luminance difference between adjacent partial regions in a dark screen is more easily perceived, while the luminance difference between adjacent partial regions in a bright screen is less perceptible. Accordingly, measurements are conducted for each of these cases, and a plurality of permissible limit values are set, and stored in the limit value storage unit 21*b*.

The image feature decision unit 18*b* receives the partial region feature quantities Fc0 and the enlarged region feature quantities Fb, and the first and second whole screen feature quantities Fc0 and Fc1, and makes a decision on the feature of the image on the basis of the received quantities.

On the basis of the result of the decision by the image feature decision unit 18*b*, the limit value selector 22 selects and reads one of the plurality of permissible limit values stored in the limit value storage unit 21*b*, and supplies the selected permissible limit value to the comparison processor 20.

For instance, when the image feature decision unit 18*b* finds that the image of the partial region of interest is dark, a relatively small permissible limit value among the plurality of permissible limit values stored in the limit value storage unit 21*b* is selected and output.

When the image feature decision unit 18*b* finds that the image in the partial region of interest is bright, a relatively large permissible limit value among the plurality of permissible limit values stored in the limit value storage unit 21*b* is selected and output.

When the difference between the luminance alteration amounts calculated by the inter-partial region difference calculator 16 exceeds the selected permissible limit value selected by the limit value selector 22, the comparison processor 20 outputs information indicating such a fact, and the degree by which the permissible limit value is exceeded, to the alteration amount adjustment unit 19.

As in Embodiment 4, the alteration amount adjustment unit 19 adjusts the luminance alteration amount data from the alteration amount data generator 14, on the basis of the information from the comparison processor 20. For instance, both of the luminance amount alteration amounts of the respective ones of the partial regions (partial region pair) adjacent to each other, between which the difference exceeds the permissible limit value, are altered to approach the luminance alteration amount of the other partial region of the pair, so that the difference between the luminance alteration amounts of these two partial regions does not exceeds the permissible limit value.

By adding the alteration amount adjustment unit 19 to the configuration in which the partial region deviation amount data Da and the enlarged region deviation amount data Db are used in order to suppress the luminance difference between adjacent partial regions, the luminance difference between adjacent partial regions can be suppressed (prevented from exceeding the permissible limit range according to the feature of the image), and the improvement in the dynamic range can be accomplished.

Embodiment 6

Figure 12:
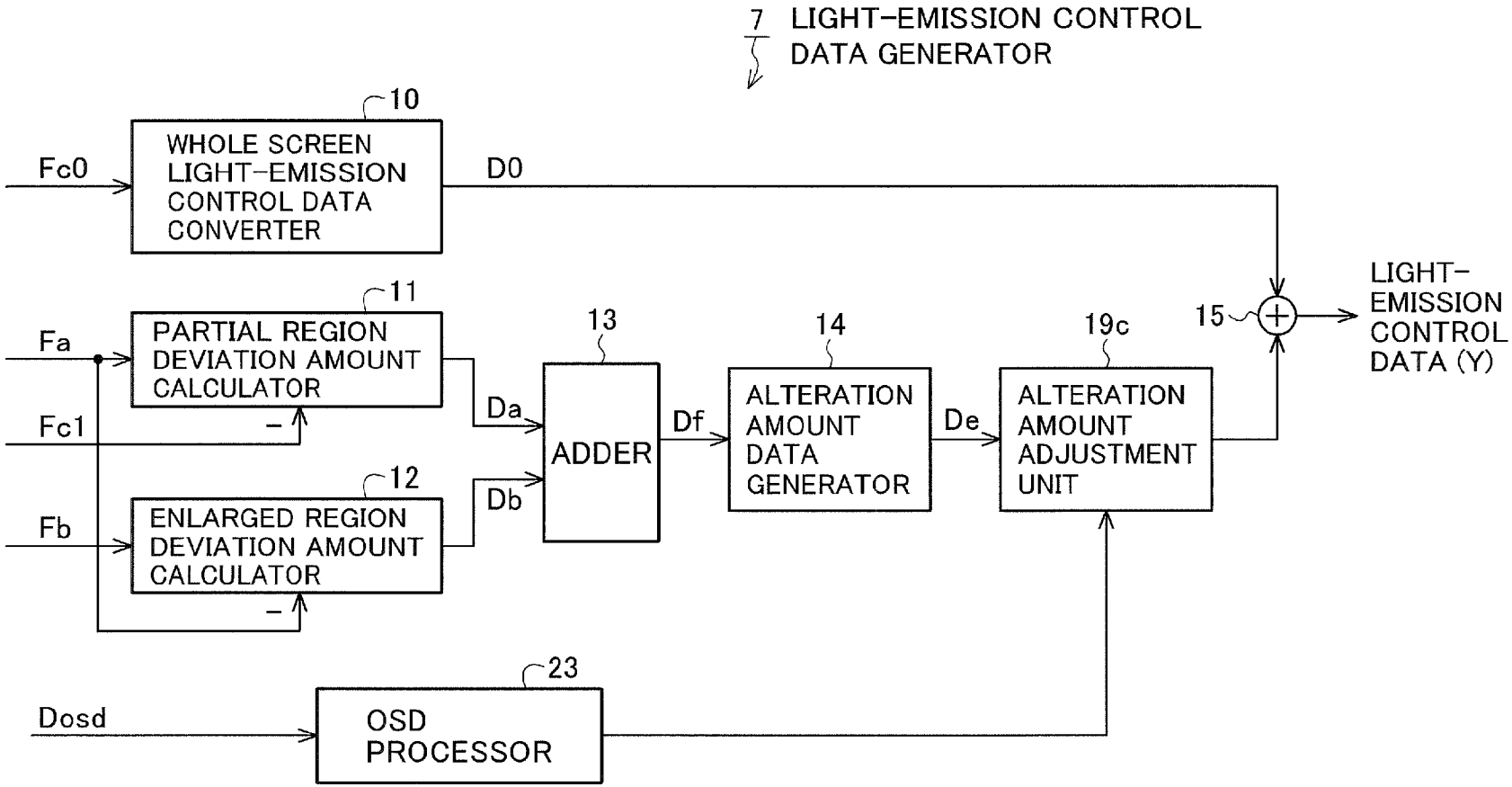
FIG. 12 is a drawing showing an example of a light-emission control data generator 7 used in Embodiment 6 of the present invention.

FIG. 12 shows a light-emission control data generator 7 used in the image display device of Embodiment 6 of the present invention. The image display device of Embodiment 6 displays on-screen display (OSD) information. The light-emission control data generator 7 shown in FIG. 12 is used in such an image display device, and includes a whole screen light-emission control data converter 10, a partial region deviation amount calculator 11, an enlarged region deviation amount calculator 12, an adder 13, an alteration amount data generator 14, an OSD processor 23, an alteration amount adjustment unit 19, and an adder 15.

Input to the OSD processor 23 is OSD display information Dosd including information indicating the contents of the on-screen display (OSD), and information indicating the position of the display. The OSD display information Dosd has characteristics different from those of the input image data output from the receiving unit 2 in FIG. 1, and it is desirable that the OSD display parts have no difference in the luminance between partial regions due to the input image data.

On the basis of the OSD display information Dosd, the OSD processor 23 detects the partial regions in which OSD display is made, and outputs information indicating the partial regions in which OSD display is made. The partial regions in which OSD display is made means the partial regions having its part or its entirety used for the OSD. FIG. 13 shows an example in which three partial regions J(7,7), J(8,7), J(9,7) at the lower right part of the screen are used for the OSD display.

The alteration amount adjustment unit 19*b* receives the luminance alteration amount data De output from the alteration amount data generator 14, adjusts the luminance alteration amounts such that the light emission luminance differences are not present between partial regions in which OSD display is indicated to be made according to the information output from the OSD processor 23. By the operation described, the luminance difference between partial regions due to the input image are suppressed to be non-perceptible in the OSD parts. In such a case, it is desirable to adjust the luminance alteration amounts of the partial regions in which OSD display is made, so that the luminance difference between the partial regions which are used for the OSD display and the partial regions which are not used for the OSD display, and which are adjacent to the partial regions which are used for the ODS display is as small as possible.

When the OSD display is made in the three partial regions J(7,7), J(8,7), J(9,7) at the lower right as shown in FIG. 13, the luminance alteration amounts of the partial regions in which the OSD display is made are adjusted such that the light emission luminance differences between these three partial regions are zero, and the sum of the absolute values of the luminance differences between the partial regions in which the OSD display is made and each of the partial regions J(7,6), J(8,6), J(9,6), J(6,7) which are adjacent to the partial regions in which OSD display is made is minimized.

The features of the embodiments described in Embodiments 1 to 6 can be used in combination with each other. For instance, the adjustment of the luminance alteration amount in the partial regions in which the OSD display is made, as explained in Embodiment 6, can also be applied to Embodiments 1 to 5.

Detailed description of the light emission control device has been made, but the light emission control method implemented by the light emission control device also forms part of the invention. The processes in the above described light emission control device, or the processes performed by the above-mentioned light emission control method can be implemented by software, i.e., a programmed computer. The program for having a computer perform the above-described processes, and a computer-readable recording medium which stores the above-mentioned program also form parts, of the invention.

Reference Characters

1: input terminal; 2: receiving unit; 3: optical modulation unit; 4: whole screen feature quantity detector; 5-1 to 5-N: light emission unit; 6: partial region feature quantity detector; 7: light-emission control data generator; 8: enlarged region feature quantity detector; 9: light emission driver; 10: whole screen light-emission control data converter; 11: partial region deviation amount calculator; 12, 12-1 to 12-M: enlarged region deviation amount calculator; 13: adder; 14: alteration amount data generator; 15: adder; 16: inter-partial region difference calculator; 17: selective adder; 18, 18*b*: image feature decision unit; 19, 19*b*: alteration amount adjustment unit; 20: comparison processor; 21, 21*b*: a limit value storage unit; 22: limit value selector; 23: OSD processor; 30: light emission controller.

What is claimed is:

1. A light emission control device for controlling light emission units irradiating respective ones of partial regions formed by dividing a display screen of an optical modulation unit for displaying an image by optically modulating illuminating light responsive to image data, such that light emission luminance of each of the partial regions can be controlled;

said light emission control device comprising:

a partial region feature quantity detector that defines each of the partial regions as a partial region of interest, and detects a feature quantity of the partial region of interest, as a partial region feature quantity;

an enlarged region feature quantity detector that detects a feature quantity of an enlarged region including the partial region of interest, and a partial region neighboring the partial region of interest, as an enlarged region feature quantity pertaining to the partial region of interest, a whole screen feature quantity detector that detects a feature quantity of entirety of the image represented by the image data, as a whole screen feature quantity; and a light emission controller that controls light emission luminance of the light emission unit corresponding to the partial region of interest, on the basis of the partial region feature quantity pertaining to the partial region of interest, the enlarged region feature quantity pertaining to the partial region of interest, and the whole screen feature quantity.

2. The light emission control device of claim 1, wherein the enlarged region feature quantity pertaining to the partial region of interest is obtained by uniform processing on the partial region feature quantity pertaining to the partial region of interest, and the partial region feature quantity of the partial region neighboring the partial region of interest, without weighting the partial region quantities.

3. The light emission control device of claim 1, wherein the light emission controller comprises:

a light-emission control data generator that generates light-emission control data for controlling the light emission luminance of the light emission unit corresponding to the partial region of interest, on the basis of the partial region feature quantity and the enlarged region feature quantity pertaining to the partial region of interest, and the whole screen feature quantity; and a light emission driver that causes the light emission unit to emit light at light emission luminance corresponding to the light-emission control data for the light emission unit, generated by the light-emission control data generator.

4. The light emission control device of claim 3, wherein the light-emission control data generator generates whole screen light-emission control data by conversion from the whole screen feature quantity, generates, for each of the plurality of partial regions, partial region deviation amount data pertaining to the partial region of interest by taking a difference between the partial region feature quantity pertaining to the partial region of interest, and the whole screen feature quantity, generates enlarged region deviation amount data pertaining to the partial region of interest, by taking a difference between the enlarged region feature quantity pertaining to the enlarged region including the partial region of interest, and the whole screen feature quantity, generates the light-emission control data pertaining to the partial region of interest from the whole screen light-emission control data, and the partial region deviation amount data and the enlarged region deviation amount data pertaining to the partial region of interest.

5. The light emission control device of claim 4, wherein the whole screen feature quantity includes a first type of whole screen feature quantity, and a second type of whole screen feature quantity, the second type being different from the first type, and the second type of the whole screen feature quantity and the partial region feature quantity and the enlarged region feature quantity are of the same type.

6. A light emission device comprising the light emission control device of claim 1, and a plurality of light emission units whose light emission luminance is controlled by the light emission control device.

7. An image display device comprising the light emission device of claim 6, and the optical modulation unit for optically modulating the illuminating light emitted from the light emission unit, according to the image data, to display an image.

8. A light emission control method for controlling light emission units irradiating respective ones of partial regions formed by dividing a display screen of an optical modulation unit for displaying an image by optically modulating illuminating light responsive to image data, such that light emission luminance of each of the partial regions can be controlled;

said light emission control method comprising:

a partial region feature quantity detecting step of defining each of the partial regions as a partial region of interest, and detecting a feature quantity of the partial region of interest, as a partial region feature quantity;

an enlarged region feature quantity detecting step of detecting a feature quantity of an enlarged region including the partial region of interest, and a partial region neighboring the partial region of interest, as an enlarged region feature quantity pertaining to the partial region of interest, a whole screen feature quantity detecting step of detecting a feature quantity of entirety of the image represented by the image data, as a whole screen feature quantity; and a light emission controlling step of controlling light emission luminance of the light emission unit corresponding to the partial region of interest, on the basis of the partial region feature quantity pertaining to the partial region of interest, the enlarged region feature quantity pertaining to the partial region of interest, and the whole screen feature quantity.

9. A non-transitory computer-readable recording medium storing a program for having a computer implement the steps of the light emission control method of claim 8.

* * * * *